US011396819B2

(12) United States Patent
Mongillo, Jr. et al.

(10) Patent No.: US 11,396,819 B2
(45) Date of Patent: Jul. 26, 2022

(54) COMPONENTS FOR GAS TURBINE ENGINES

(71) Applicant: Raytheon Technologies Corporation, Farmington, CT (US)

(72) Inventors: Dominic J. Mongillo, Jr., West Hartford, CT (US); Daniel P. Preuss, Newington, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 0 days.

(21) Appl. No.: 16/851,720

(22) Filed: Apr. 17, 2020

(65) Prior Publication Data

US 2020/0332667 A1 Oct. 22, 2020

Related U.S. Application Data

(60) Provisional application No. 62/835,823, filed on Apr. 18, 2019.

(51) Int. Cl.
*F01D 5/18* (2006.01)

(52) U.S. Cl.
CPC ..... *F01D 5/189* (2013.01); *F05B 2240/30* (2013.01); *F05B 2260/232* (2013.01)

(58) Field of Classification Search
CPC ..... F01D 5/186; F01D 5/187; F01D 5/188; F01D 5/189
See application file for complete search history.

(56) References Cited

U.S. PATENT DOCUMENTS

| | | | | |
|---|---|---|---|---|
| 4,153,386 | A * | 5/1979 | Leogrande | F01D 5/188 415/115 |
| 4,461,612 | A | 7/1984 | Dodd | |
| 5,259,730 | A | 11/1993 | Damlis et al. | |
| 5,419,039 | A | 5/1995 | Auxier et al. | |
| 6,428,273 | B1 * | 8/2002 | Keith | F01D 9/04 416/97 R |
| 6,769,875 | B2 * | 8/2004 | Tiemann | F01D 5/189 416/233 |
| 7,056,083 | B2 | 6/2006 | Gray | |
| 8,500,405 | B1 | 8/2013 | Jones et al. | |

(Continued)

FOREIGN PATENT DOCUMENTS

JP S61118504 A 6/1986

*Primary Examiner* — Courtney D Heinle
*Assistant Examiner* — Michael K. Reitz
(74) *Attorney, Agent, or Firm* — Cantor Colburn LLP

(57) ABSTRACT

Components for gas turbine engines are described. The components include an airfoil having a leading edge cavity with a baffle portion and a leading edge portion. A baffle is installed within the baffle portion and includes a first metering flow aperture. A first support element retention feature is located within the leading edge cavity. A first axial extending rib extends between an aft end of the cavity and a forward end proximate the first support element retention feature and is formed on an interior surface of the airfoil. A first axial extending flow channel extends along the first axial extending rib between an exterior surface of the baffle and an interior surface of the airfoil and the first metering flow aperture is located proximate the aft end of the first axial extending flow channel to generate a forward flowing cooling flow.

20 Claims, 15 Drawing Sheets

(56) References Cited

U.S. PATENT DOCUMENTS

| | | | | |
|---|---|---|---|---|
| 9,011,077 | B2 | 4/2015 | Vitt et al. | |
| 9,840,930 | B2 | 12/2017 | Lee et al. | |
| 9,850,763 | B2 | 12/2017 | Itzel et al. | |
| 10,024,172 | B2 | 7/2018 | Boeke et al. | |
| 2003/0049127 | A1* | 3/2003 | Tiemann | F01D 5/189 416/97 R |
| 2016/0201476 | A1* | 7/2016 | Bunker | F01D 5/186 415/115 |
| 2016/0222796 | A1 | 8/2016 | Spangler et al. | |
| 2017/0030199 | A1* | 2/2017 | Barker | F01D 5/187 |
| 2017/0051612 | A1* | 2/2017 | Sezer | F02C 7/12 |
| 2018/0149028 | A1* | 5/2018 | Dutta | F01D 25/14 |

* cited by examiner

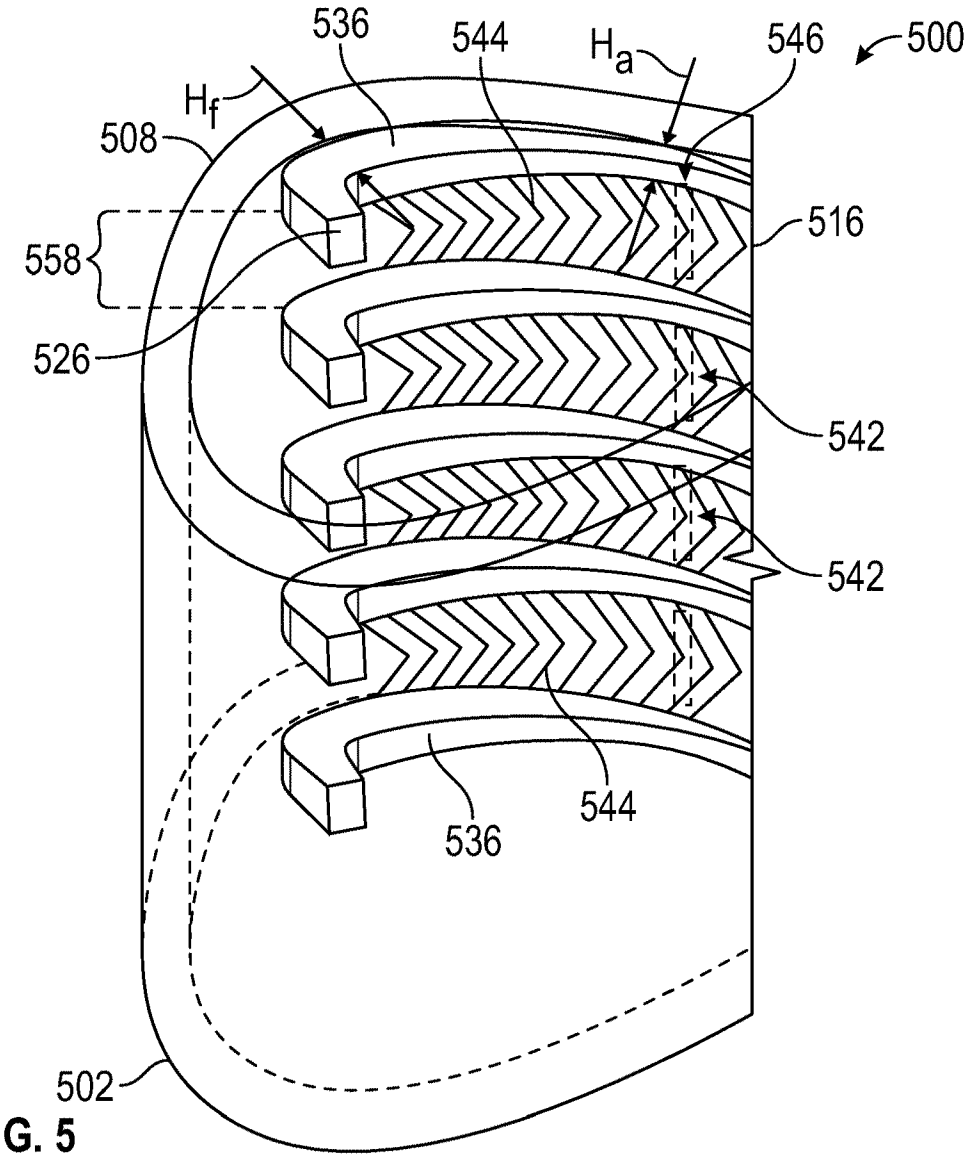
FIG. 5
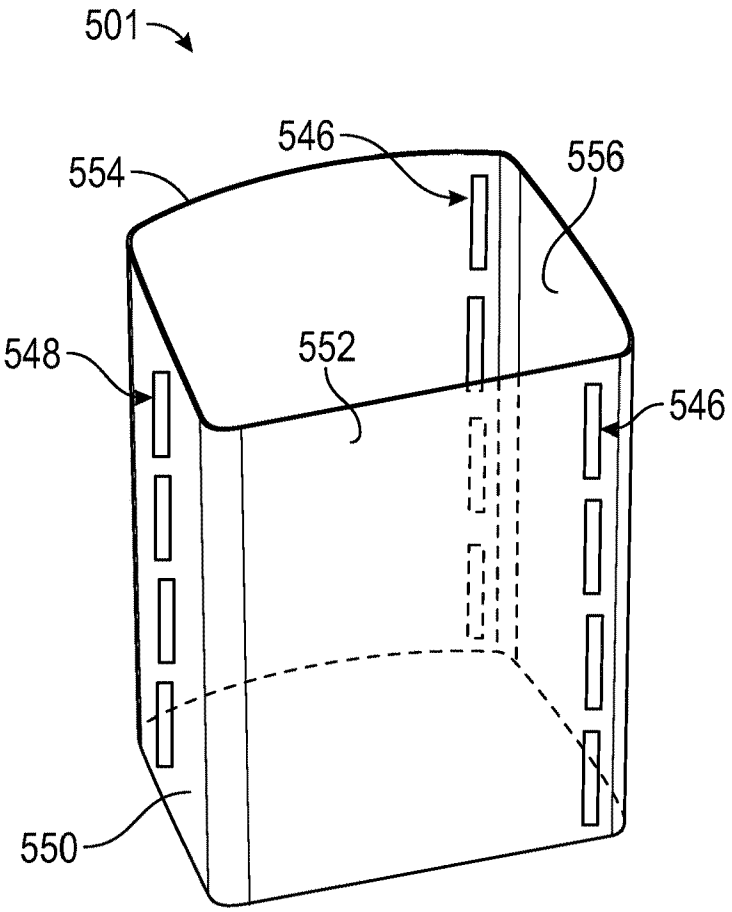

COMPONENTS FOR GAS TURBINE ENGINES

CROSS REFERENCE TO RELATED APPLICATIONS

This application claims the benefit of an earlier filing date from U.S. Provisional Application Ser. No. 62/835,823, filed Apr. 18, 2019, the entire disclosure of which is incorporated herein by reference.

BACKGROUND

Illustrative embodiments pertain to the art of turbomachinery, and specifically to turbine rotor components.

Gas turbine engines are rotary-type combustion turbine engines built around a power core made up of a compressor, combustor and turbine, arranged in flow series with an upstream inlet and downstream exhaust. The compressor compresses air from the inlet, which is mixed with fuel in the combustor and ignited to generate hot combustion gas. The turbine extracts energy from the expanding combustion gas, and drives the compressor via a common shaft. Energy is delivered in the form of rotational energy in the shaft, reactive thrust from the exhaust, or both.

The compressor and turbine sections are typically subdivided into a number of stages, which are formed of alternating rows of rotor blade and stator vane airfoils. The airfoils are shaped to turn, accelerate and compress the working fluid flow, or to generate lift for conversion to rotational energy in the turbine.

Airfoils may incorporate various cooling cavities located adjacent external side walls. Such cooling cavities are subject to both hot material walls (exterior or external) and cold material walls (interior or internal). Although such cavities are designed for cooling portions of airfoil bodies, various cooling flow characteristics can cause hot sections where cooling may not be sufficient. Accordingly, improved means for providing cooling within an airfoil may be desirable.

BRIEF DESCRIPTION

According to some embodiments, components for gas turbine engines are provided. The components include an airfoil having a leading edge, a trailing edge, a pressure side, and a suction side, wherein the airfoil defines at least a leading edge cavity located proximate the leading edge and defined between the leading edge and a separator rib in an axial direction and between the pressure side and the suction side in a circumferential direction, the leading edge cavity comprising a baffle portion and a leading edge portion, with the baffle portion aft of the leading edge portion in the axial direction. A baffle is installed within the baffle portion of the leading edge cavity, the baffle having a first metering flow aperture. A first support element retention feature is located within the leading edge cavity and at least partially separating the baffle portion from the leading edge portion, the first support element retention feature on one of the pressure side and the suction side of the leading edge cavity. A first axial extending rib extends between an aft end proximate the separator rib of the leading edge cavity and a forward end proximate the first support element retention feature and formed on an interior surface of a same side as the first support element retention feature. A first axial extending flow channel is defined along the first axial extending rib between an exterior surface of the baffle and an interior surface of the airfoil and extending from the aft end to the forward end in an axial direction, and the first metering flow aperture is located proximate the aft end of the first axial extending flow channel such that air flowing through the first metering flow aperture into the first axial extending flow channel will flow forward toward the leading edge portion of the leading edge cavity.

In addition to one or more of the features described herein, or as an alternative, further embodiments of the components may include a plurality of additional axial extending ribs arranged on the same interior surface as the first axial extending rib, wherein a plurality of additional axial extending flow channels are defined between adjacent axial extending ribs.

In addition to one or more of the features described herein, or as an alternative, further embodiments of the components may include a second support element retention feature located within the leading edge cavity and at least partially separating the baffle portion from the leading edge portion, the second support element retention feature on the other of the pressure side and the suction side of the leading edge cavity from the first support element retention feature, a second axial extending rib extending between the aft end proximate the separator rib of the leading edge cavity and the forward end proximate the second support element retention feature and formed on an interior surface of a same side as the second support element retention feature, wherein a second axial extending flow channel is defined along the second axial extending rib between an exterior surface of the baffle and an interior surface of the airfoil and extending from the aft end to the forward end in an axial direction.

In addition to one or more of the features described herein, or as an alternative, further embodiments of the components may include that the baffle comprises at least one impingement aperture configured to fluidly connect to the leading edge portion of the leading edge cavity.

In addition to one or more of the features described herein, or as an alternative, further embodiments of the components may include that the first axial extending rib has a variable radial height in a direction from the aft end to the forward end.

In addition to one or more of the features described herein, or as an alternative, further embodiments of the components may include that the interior surface of the airfoil defining a portion of the first axial extending flow channel includes at least one heat transfer augmentation feature.

In addition to one or more of the features described herein, or as an alternative, further embodiments of the components may include that the at least one heat transfer augmentation feature comprises at least one of trip strips, pin fins, and pedestals.

In addition to one or more of the features described herein, or as an alternative, further embodiments of the components may include that the at least one heat transfer augmentation feature comprises a plurality of heat transfer augmentation features that extend along the interior surface of the airfoil from the separator rib into the leading edge portion of the leading edge cavity.

In addition to one or more of the features described herein, or as an alternative, further embodiments of the components may include at least one film cooling hole formed on the airfoil to fluidly connect the leading edge portion to an exterior of the airfoil.

In addition to one or more of the features described herein, or as an alternative, further embodiments of the components may include a second metering flow aperture defined at least partially by the first support element retention feature at the forward end of the first axial extending flow channel.

In addition to one or more of the features described herein, or as an alternative, further embodiments of the components may include a second axial extending rib extending between the aft end and the forward end and the first axial extending rib and the second axial extending rib are not parallel to each other.

According to some embodiments, gas turbine engines are provided. The gas turbine engines include an airfoil having a leading edge, a trailing edge, a pressure side, and a suction side, wherein the airfoil defines at least a leading edge cavity located proximate the leading edge and defined between the leading edge and a separator rib in an axial direction and between the pressure side and the suction side in a circumferential direction, the leading edge cavity comprising a baffle portion and a leading edge portion, with the baffle portion aft of the leading edge portion in the axial direction; a baffle installed within the baffle portion of the leading edge cavity, the baffle having a first metering flow aperture; a first support element retention feature located within the leading edge cavity and at least partially separating the baffle portion from the leading edge portion, the first support element retention feature on one of the pressure side and the suction side of the leading edge cavity; a first axial extending rib extending between an aft end proximate the separator rib of the leading edge cavity and a forward end proximate the first support element retention feature and formed on an interior surface of a same side as the first support element retention feature, wherein a first axial extending flow channel is defined along the first axial extending rib between an exterior surface of the baffle and an interior surface of the airfoil and extending from the aft end to the forward end in an axial direction, and wherein the first metering flow aperture is located proximate the aft end of the first axial extending flow channel such that air flowing through the first metering flow aperture into the first axial extending flow channel will flow forward toward the leading edge portion of the leading edge cavity.

In addition to one or more of the features described herein, or as an alternative, further embodiments of the gas turbine engines may include a plurality of additional axial extending ribs arranged on the same interior surface as the first axial extending rib, wherein a plurality of additional axial extending flow channels are defined between adjacent axial extending ribs.

In addition to one or more of the features described herein, or as an alternative, further embodiments of the gas turbine engines may include a second support element retention feature located within the leading edge cavity and at least partially separating the baffle portion from the leading edge portion, the second support element retention feature on the other of the pressure side and the suction side of the leading edge cavity from the first support element retention feature; a second axial extending rib extending between the aft end proximate the separator rib and the forward end proximate the second support element retention feature and formed on an interior surface of a same side as the second support element retention feature, wherein a second axial extending flow channel is defined along the second axial extending rib between an exterior surface of the baffle and an interior surface of the airfoil and extending from the aft end to the forward end in an axial direction.

In addition to one or more of the features described herein, or as an alternative, further embodiments of the gas turbine engines may include that the baffle comprises at least one impingement aperture configured to fluidly connect to the leading edge portion of the leading edge cavity.

In addition to one or more of the features described herein, or as an alternative, further embodiments of the gas turbine engines may include that the first axial extending rib has a variable radial height in a direction from the aft end to the forward end.

In addition to one or more of the features described herein, or as an alternative, further embodiments of the gas turbine engines may include that the interior surface of the airfoil defining a portion of the first axial extending flow channel includes at least one heat transfer augmentation feature.

In addition to one or more of the features described herein, or as an alternative, further embodiments of the gas turbine engines may include that the at least one heat transfer augmentation feature comprises at least one of trip strips, pin fins, and pedestals.

In addition to one or more of the features described herein, or as an alternative, further embodiments of the gas turbine engines may include that the at least one heat transfer augmentation feature comprises a plurality of heat transfer augmentation features that extend along the interior surface of the airfoil from the separator rib into the leading edge portion of the leading edge cavity.

In addition to one or more of the features described herein, or as an alternative, further embodiments of the gas turbine engines may include at least one film cooling hole formed on the airfoil to fluidly connect the leading edge portion to an exterior of the airfoil.

In addition to one or more of the features described herein, or as an alternative, further embodiments of the gas turbine engines may include a second metering flow aperture defined at least partially by the first support element retention feature at the forward end of the first axial extending flow channel.

In addition to one or more of the features described herein, or as an alternative, further embodiments of the gas turbine engines may include a second axial extending rib extending between the aft end and the forward end and the first axial extending rib and the second axial extending rib are not parallel to each other.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be illustrative and explanatory in nature and non-limiting.

BRIEF DESCRIPTION OF THE DRAWINGS

The following descriptions should not be considered limiting in any way. With reference to the accompanying drawings, like elements are numbered alike: The subject matter is particularly pointed out and distinctly claimed at the conclusion of the specification. The foregoing and other features, and advantages of the present disclosure are apparent from the following detailed description taken in conjunction with the accompanying drawings in which like elements may be numbered alike and:

FIG. 5 is a schematic partially exploded illustrative view of an airfoil and baffle in accordance with an embodiment of the present disclosure;

DETAILED DESCRIPTION

Detailed descriptions of one or more embodiments of the disclosed apparatus and/or methods are presented herein by way of exemplification and not limitation with reference to the Figures.

Figure 1:
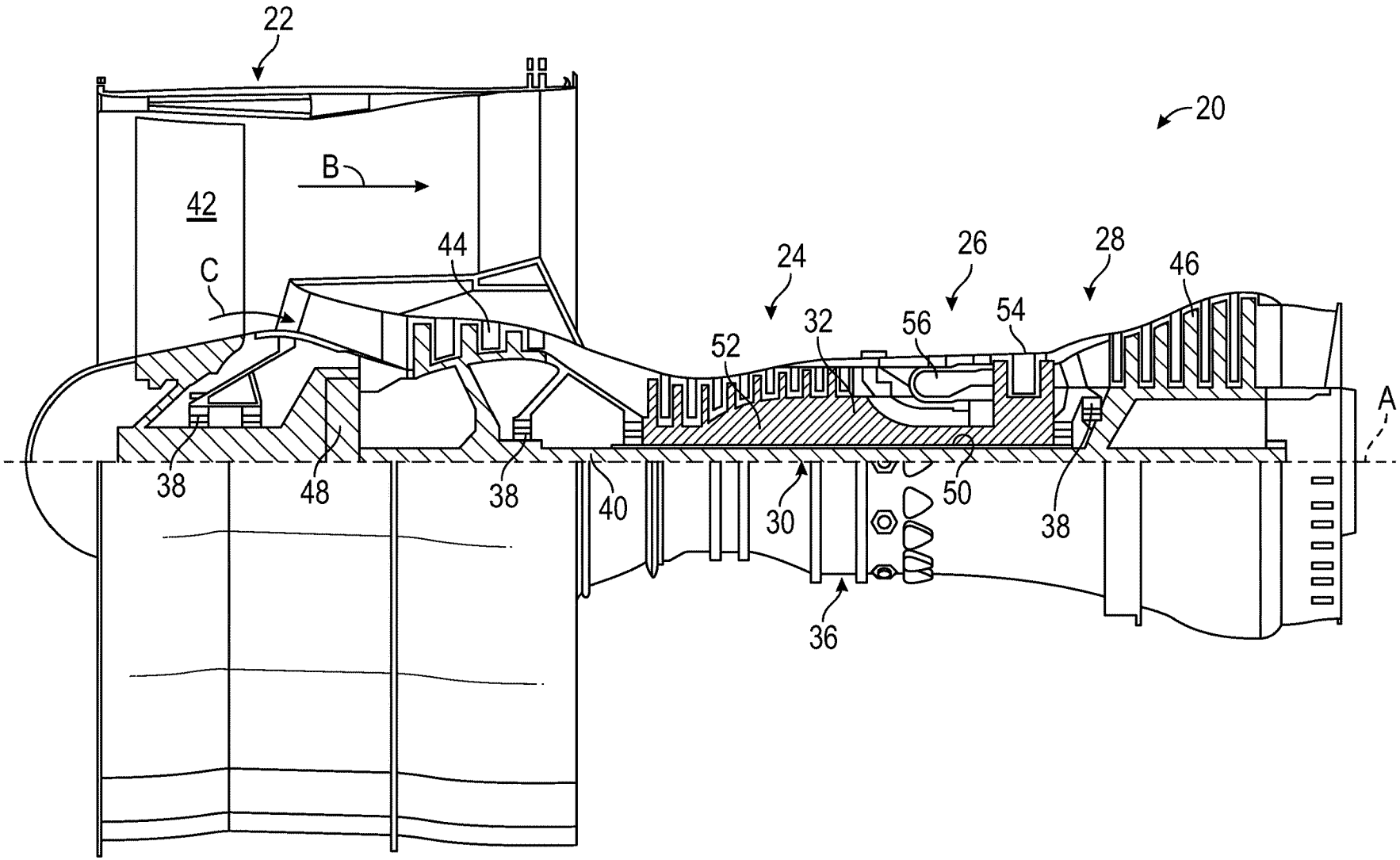
FIG. 1 is a schematic cross-sectional illustration of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. The fan section 22 drives air along a bypass flow path B in a bypass duct, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a low pressure compressor 44 and a low pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged in exemplary gas turbine 20 between the high pressure compressor 52 and the high pressure turbine 54. An engine static structure 36 is arranged generally between the high pressure turbine 54 and the low pressure turbine 46. The engine static structure 36 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one non-limiting example is a high-bypass geared aircraft engine. In a further non-limiting example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present disclosure is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,688 meters). The flight condition of 0.8 Mach and 35,000 ft (10,688 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(514.7^\circ\ \text{R})]^{0.5}$. The "Low corrected fan tip speed" as disclosed herein according to one non-limiting embodiment is less than about 1150 ft/second (350.5 m/sec).

Although the gas turbine engine 20 is depicted as a turbofan, it should be understood that the concepts described herein are not limited to use with the described configuration, as the teachings may be applied to other types of engines such as, but not limited to, turbojets, turboshafts, etc.

Figure 2:
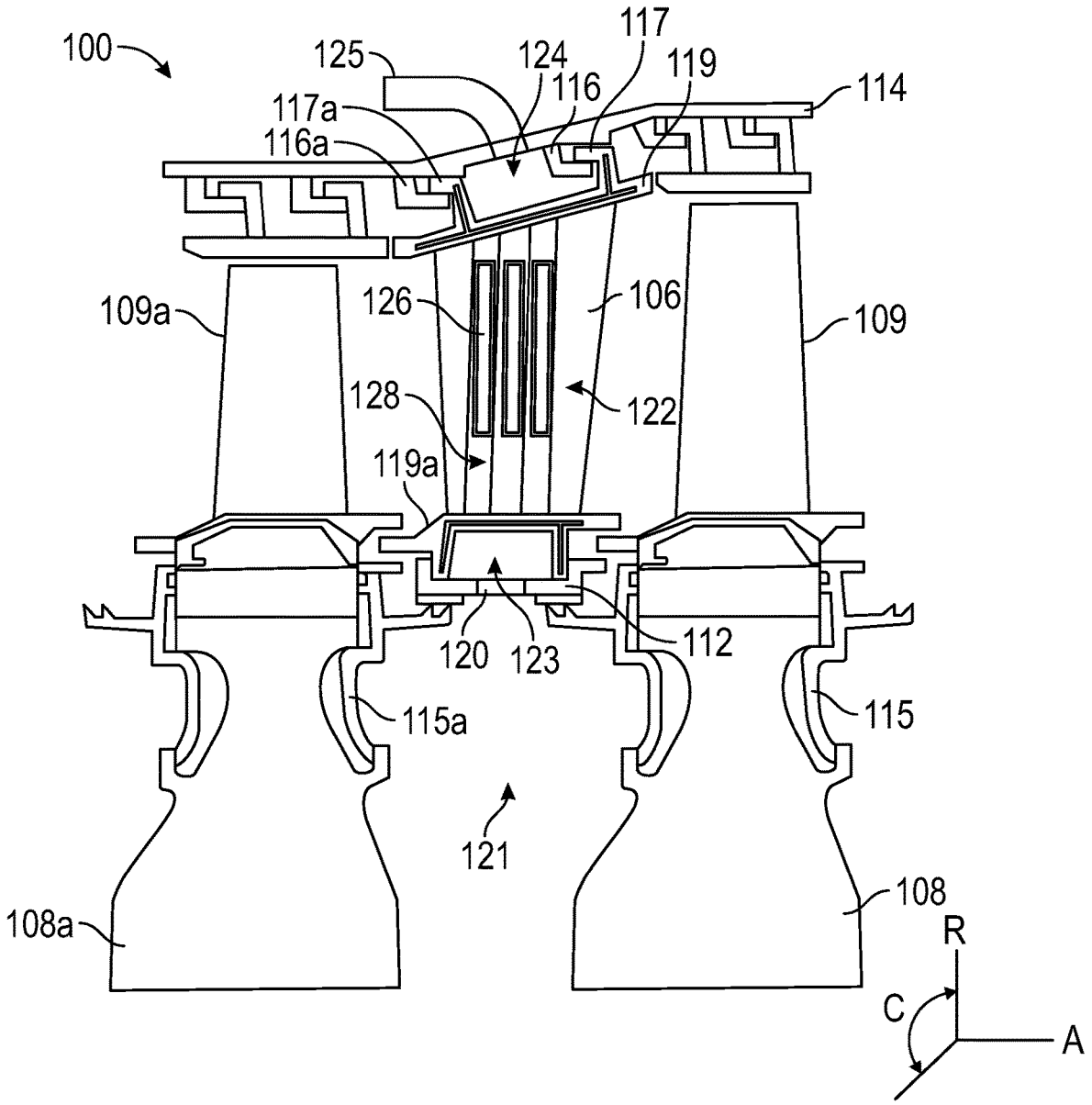
FIG. 2 is a schematic illustration of a portion of a turbine section of the gas turbine engine of FIG. 1.

Referring now to FIG. 2, a cooling design in a turbine section 28 for a gas turbine engine 20 may utilize a vane 106 disposed between axially adjacent bladed full hoop disks 108, 108*a* having respective blades 109, 109*a*. As shown, vane 106 is disposed radially between an inner air seal 112 and a full hoop case 114 on an outer side. Inner air seal 112 may be a full hoop structure supported by opposing vanes, including a plurality of vanes 106 that are separated in a circumferential direction. Vane 106 is supported by the full hoop case 114 through segmented vane hooks 117, 117*a*. One or more full hoop cover plates 115, 115*a* may minimize leakage between the vane 106 and the blades 109, 109*a*. The vane 106 is radially supported by the full hoop case 114 with segmented case hooks 116, 116*a* in mechanical connection with the segmented vane hooks 117, 117*a*. The vane 106 may be circumferentially supported between circumferentially adjacent platforms 119, 119*a* which may include feather seals that can minimize leakage between the adjacent vanes 106 into the gas path.

Although FIG. 2 depicts a second stage vane, as appreciated by those of skill in the art, embodiments provided herein can be applicable to first stage vanes as well. Such first stage vanes may have cooling flow supplied to the vane at both the inner and outer diameters, as opposed to the through-flow style cavity which goes from, for example, outer diameter to inner diameter. Thus, the present illustrations are not to be limiting but are rather provided for illustrative and explanatory purposes only.

In the present illustration, a turbine cooling air (TCA) conduit 125 provides cooling air into an outer diameter vane cavity 124 defined in part by an outer platform 119 and the full hoop case 114. The vane 106 is hollow so that air can travel radially into and longitudinally downstream from the outer diameter vane cavity 124, through the vane 106 via one or more vane cavities 122, and into a vane inner diameter cavity 123. The vane inner diameter cavity 123 is defined, in part, by an inner platform 119*a*. Thereafter air may travel through an orifice 120 in the inner air seal 112 and into a rotor cavity 121. Accordingly, cooling air for at least portions of the vane 106 will flow from a platform region, into the vane, and then out of the vane and into another platform region and/or into a hot gaspath/main gaspath. In some arrangements, the platforms 119, 119*a* can include ejection holes to enable some or all of the air to be injected into the main gaspath.

It is to be appreciated that the longitudinal orientation of vane 106 is illustrated in a radial direction, but other orientations for vane 106 are within the scope of the disclosure. In such alternate vane orientations, fluid such as cooling air can flow into the vane cavity 122 through an upstream opening illustrated herein as outer diameter cavity 124 and out through a downstream opening in vane cavity 122 illustrated herein as inner diameter cavity 123. A longitudinal span of vane cavity 122 being between such openings.

The vane 106, as shown, includes one or more baffles 126 located within the vane 106. The baffles 126 are positioned within one or more respective baffle cavities 128. The baffle cavities 128 are sub-portions or sub-cavities of the vane cavity 122. In some embodiments, such as shown in FIG. 2, the baffle cavities 128 are internal cavities that are axially inward from the leading and trailing edges of the vane 106, although such arrangement is not to be limiting. The TCA conduit 125 may provide cooling air that can flow into the baffles 126 and then impinge from the respective baffle 126 onto an interior surface of the vane 106.

As shown and labeled in FIG. 2, a radial direction R is upward on the page (e.g., radial with respect to an engine axis) and an axial direction A is to the right on the page (e.g., along an engine axis). Thus, radial cooling flows will travel up or down on the page and axial flows will travel left-to-right (or vice versa). A circumferential direction C is a direction into and out of the page about the engine axis.

Figure 3A:
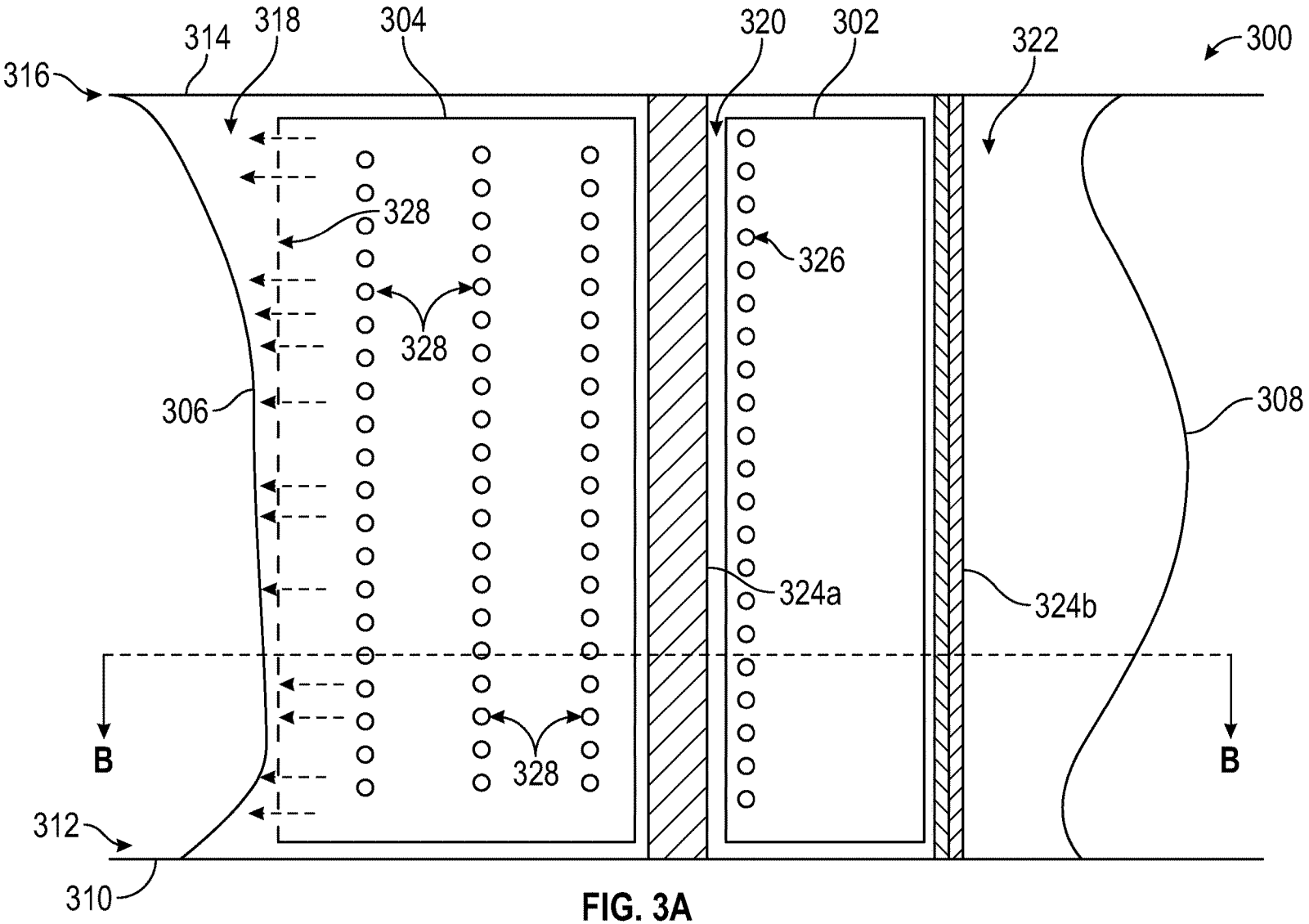
FIG. 3A (Prior Art)
FIG. 3A is an elevation schematic illustration of an airfoil.
Figure 3B:
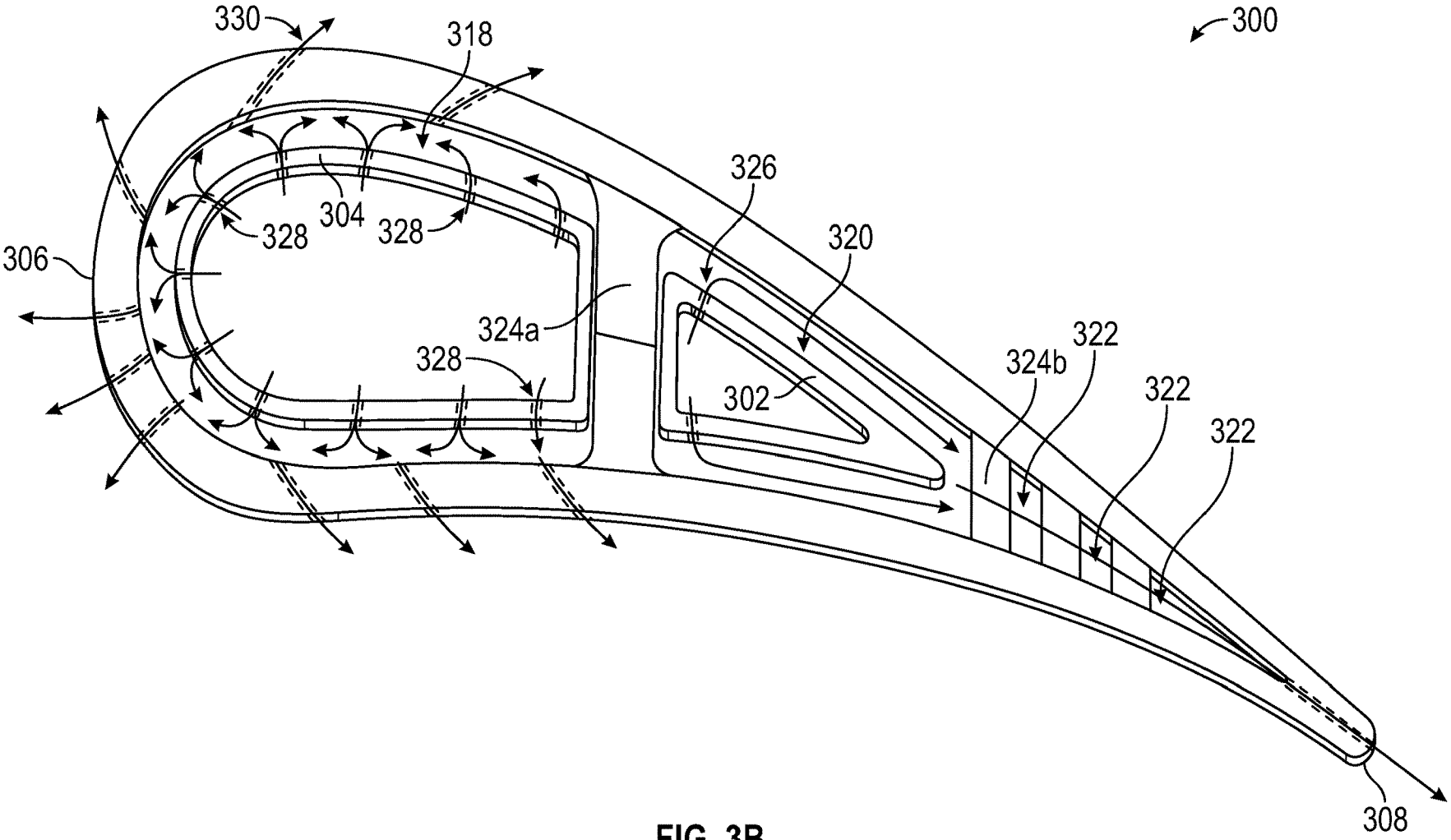
FIG. 3B (Prior Art)
FIG. 3B is a cross-sectional illustration of the airfoil of FIG. 3A as viewed along the line B-B.

Turning now to FIGS. 3A-3B, schematic illustrations of an airfoil 300 having a first baffle 302 and a second baffle 304 installed therein are shown. Each baffle 302, 304 has a baffle body that defines the structure and shape of the respective baffle 302, 304. The airfoil 300 extends in an axial direction between a leading edge 306 and a trailing edge 308. In a radial direction, the airfoil 300 extends between an inner platform 310 at an inner diameter 312 and an outer platform 314 at an outer diameter 316. In this illustrative embodiment, the airfoil 300 has three internal cavities: a leading edge cavity 318, a mid-cavity 320, and a trailing edge cavity 322. Although shown with a specific cavity configuration, those of skill in the art will appreciate that airfoils can have a variety of internal cavity configurations and implement embodiment of the present disclosure. Thus, the present illustration is merely for explanatory purposes and is not to be limiting. FIG. 3A is a side elevation illustration of the airfoil 300 illustrating an internal structure thereof. FIG. 3B is a cross-sectional illustration as viewed along the line B-B.

The cavities 318, 320, 322 may be separated by ribs 324*a*, 324*b*, with fluid connections therebetween in some embodiments. The ribs 324*a*, 324*b* extend radially between the inner platform 310 at the inner diameter 312 to the outer platform 314 at the outer diameter 316. A first rib 324*a* may separate the mid-cavity 320 from the leading edge cavity 318, and may, in some embodiments, fluidly separate the two cavities 318, 320. A second rib 324*b* may separate the mid-cavity 320 from the trailing edge cavity 322, and may, in some embodiments, have through holes to fluidly connect the mid-cavity 320 to the trailing edge cavity 322.

In this embodiment, the leading edge cavity 318 includes the second baffle 304 installed therein and the mid-cavity 320 includes the first baffle 302 therein. The first baffle 302 includes first baffle holes 326 (shown in FIG. 3B) to supply cooling air from within the first baffle 302 into the mid-cavity 320. The cooling air within the mid-cavity 320 may flow into the trailing edge cavity 322 and subsequently exit the airfoil 300 as known in the art. The second baffle 304 includes second baffle holes 328 where cooling air within the second baffle 304 may impinge upon surfaces of the airfoil 300 of the leading edge cavity 318. The cooling or impinged air may then exit the leading edge cavity 318 through film cooling holes 330, as will be appreciated by those of skill in the art.

In some airfoils, the leading edge may not include a baffle, but rather may include a leading edge feed cavity and a leading edge impingement cavity, wherein flow from the leading edge feed cavity will flow through impingement apertures to impinge upon a leading edge hot wall, and then exit the leading edge impingement cavity through film cooling holes. Aft of the leading edge cavity arrangement may be one or more additional cavities, which typically includes a trailing edge cavity. In such airfoil arrangements, the leading edge is typically fed by a high pressure source for high compressor discharge air. The trailing edge, in contrast, may be fed from a mid-compressor bleed source, which is a lower pressure source. However, utilizing high pressure air may be undesirable from a thermodynamic cycle efficiency perspective. That being said, high pressure air is sometimes required to meet leading edge back flow margin requirements because a mid-compressor bleed feed source may not have high enough pressure to adequately ensure positive out-flow through leading edge film cooling holes. The leading edge film cooling may be required to effectively cool the leading region of the airfoil to prevent premature through-wall oxidation due to excessively high metal temperatures resulting from high external gas temperatures and heat flux.

Due to these considerations, the high pressure source that feeds the leading edge feed cavity can result in a significantly higher pressure ratio than required and/or desired. The leading edge pressure ratio is defined by the ratio of the supply feed pressure and the total free stream gas pressure at the leading edge of the airfoil, commonly referred to as the stagnation pressure. As a result of the high supply pressure and high leading edge pressure ratio, it may become desirable and necessary to "meter" the cooling air flow in order to meet allocated cooling flow requirements.

The high leading edge pressure ratio increases the cooling flow rate for a constant exit flow area (i.e., film cooling holes) resulting in high blowing ratios across the rows of leading edge film cooling holes. Although high blowing ratios are desirable to achieve high Reynolds numbers within the film cooling holes to increase convective cooling, such high blowing ratios may be undesirable from a film cooling perspective. Film cooling holes with excessively high blowing ratios have a tendency to have poor film cooling characteristics because the cooling flow emanating from the film holes may "blow off" and separate from the airfoil surface. This separation may prevent a desired "film" of cooling air along the exterior surface of the airfoil.

One solution is to meter the flow from the high pressure cooling supply source. The metering of the pressure may be achieved by introducing a relatively "small" feed orifice in order to reduce or "drop" the high supply pressure source by incurring additional pressure losses resulting from a small inlet feed area and sharped edge sudden contraction that results. However, reducing pressure in order to achieve a lower leading edge pressure ratio to mitigate cooling high flow rates is not desirable from a convective heat transfer perspective. This is because the lower pressure levels inherently result in a reduction in the absolute level of convective heat transfer that is otherwise achievable at a higher pressure level.

In some prior art embodiments, the incorporation of a small inlet feed aperture may be utilized to "meter" cooling flow rate in order to achieve desirably leading edge showerhead cooling flow levels and pressure ratios in order to improve local film cooling characteristics. The small inlet feed aperture serves as a flow restrictor in order to meter the cooling air flow rate by inducing significant pressure loss and, in this sense, the high supply pressure source is not utilized effective to provide necessary internal convective cooling.

In order to restrict the cooling flow rate, a single flow aperture having a relatively small cross-sectional area is required. However, a small leading edge feed orifice may be undesirable because it may be prone to plugging from debris within the engine, either from surrounding hardware such as brush seals, w-seals, and/or from dirt/sand particulate that is in the environment that the engine is subjected to in certain parts of the world. Further, in some solutions, due to other considerations, as discussed above, the sourced cooling air/pressure may be underutilized.

In an effort to utilize the high pressure supply source and, correspondingly, the high pressure ratio that exists across the leading edge film cooling holes, a more effective means of reducing or lowering the available pressure is to induce pressure losses through the incorporation of internal convective cooling features, such as baffle impingement apertures, turbulators, trip strips, pin fins and/or pedestal geometry features. In this sense, the high supply pressure source can be utilized more effectively by providing internal hot wall convective cooling in order to increase the local thermal cooling effectiveness, thereby reducing operating metal temperatures and improve overall part capability and durability. Those skilled in the art will appreciate that the increased frictional losses and pressure losses associated with the incorporation of internal cooling geometric features, which are used to promote local cooling flow vortices that induce turbulent mixing and in turn, enhance convective cooling characteristics immediate the hot internal wall surfaces.

Embodiments of the present disclosure are directed to incorporating a leading edge counter flow "space-eater" baffle concept. The "space-eater" baffle concept includes a plurality of predominantly axial rib offsets. Such axial rib offsets may include a second metering flow aperture defined at least partially by a first support element retention feature at the forward end of the first axial extending rib offset feature. The axial cooling channels are formed between the exterior surface of the "space-eater" baffle insert and the axial extending rib offset features, which serve to segregate the axial flow channels. The discrete axial channels may be smooth and/or rib roughened cooling channels to promote and enhance internal convective cooling. The channels may include various unique convective heat transfer cooling features proximate the internal surface of the leading edge of an airfoil. In various embodiments, an axial channel flow area formed between a baffle exterior and interior surfaces of the airfoil, in an axial stream wise direction, may be constant, converging, and/or diverging channel flow areas controlled by variable axial rib heights. As discussed herein, the term "axial" refers to a direction relative to an engine axis, when the airfoil is installed within such engine (e.g., as shown in FIG. 2). The axial direction is a direction between a leading edge and a trailing edge of the airfoil, with a forward flow direction being a direction from the trailing edge toward the leading edge (an aft flow is a direction from the leading edge toward the trailing edge).

The "space-eater" baffle is a counter-flow (i.e., aft-to-forward flow) cooling concept in which a high pressure feed source can be leveraged by managing pressure losses within the cooling system in order to provide more efficient and effective use of cooling airflow for improved convective heat transfer and film cooling of the airfoil. Optimization or control of pressure loss within the cooling design, in accordance with embodiments of the present disclosure, may be achieved through various heat transfer features and orifices within the airfoil. For example, leading edge "space-eater" baffle feed and/or resupply flow apertures (e.g., size and shape thereof) may be independently tailored specifically for each pressure side and suction side axial flow channel to optimize both the radial and axial cooling flow distribution in each of the axial flow channels created between the exterior surface of the "space-eater" baffle and the interior surface of the airfoil external wall. Axial channel flow area, trip strip type, pitch, height, and spacing are other types of examples of creating the desired axial channel cooling flow Mach number, Reynolds number, convective heat transfer, pressure loss, and mass flow rate through axial channels of the present disclosure.

Figure 4A:
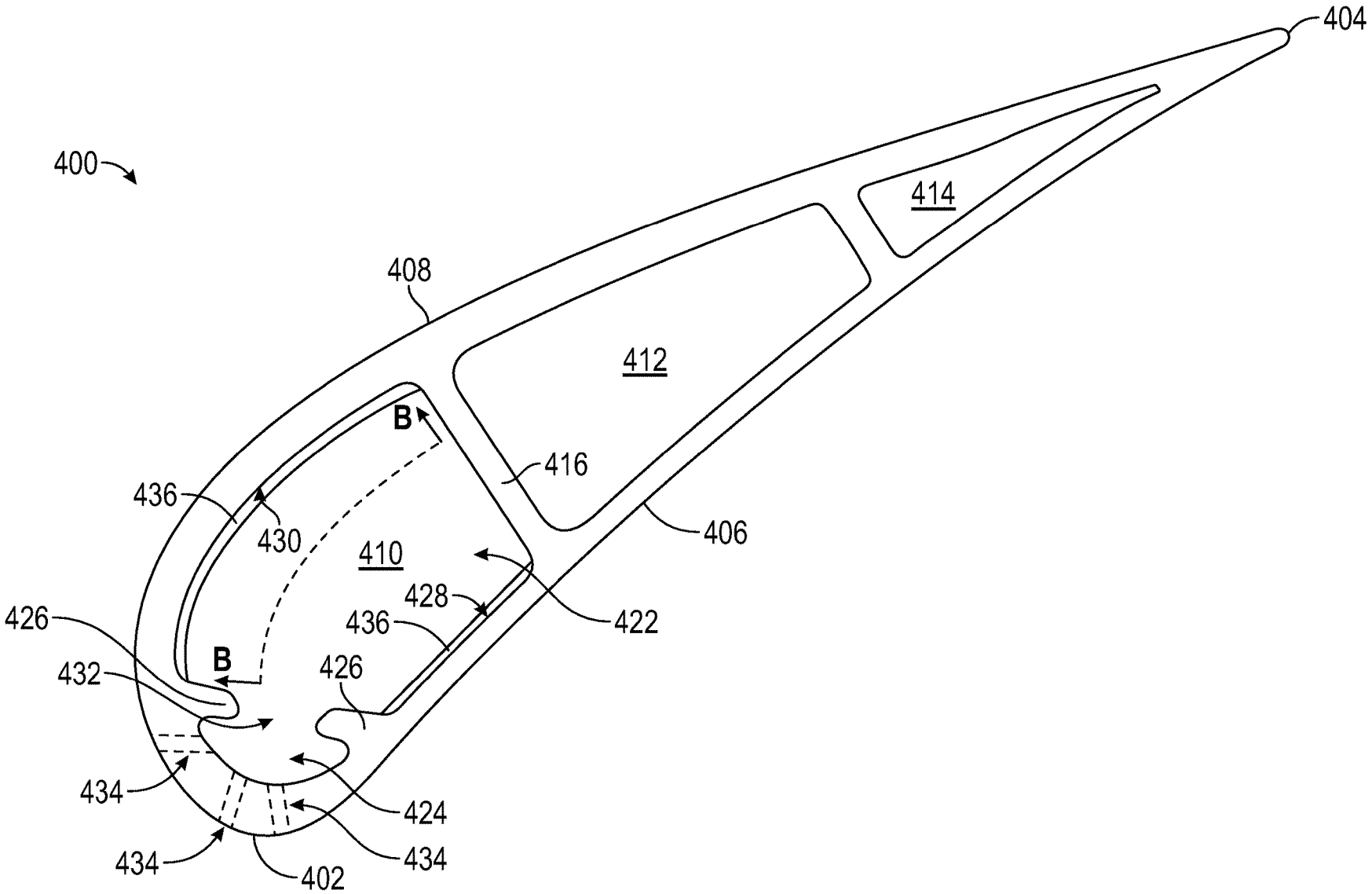
FIG. 4A illustrates an airfoil in accordance with an embodiment of the present disclosure in a top-down cross-sectional view showing an interior structure of the airfoil.
Figure 4B:
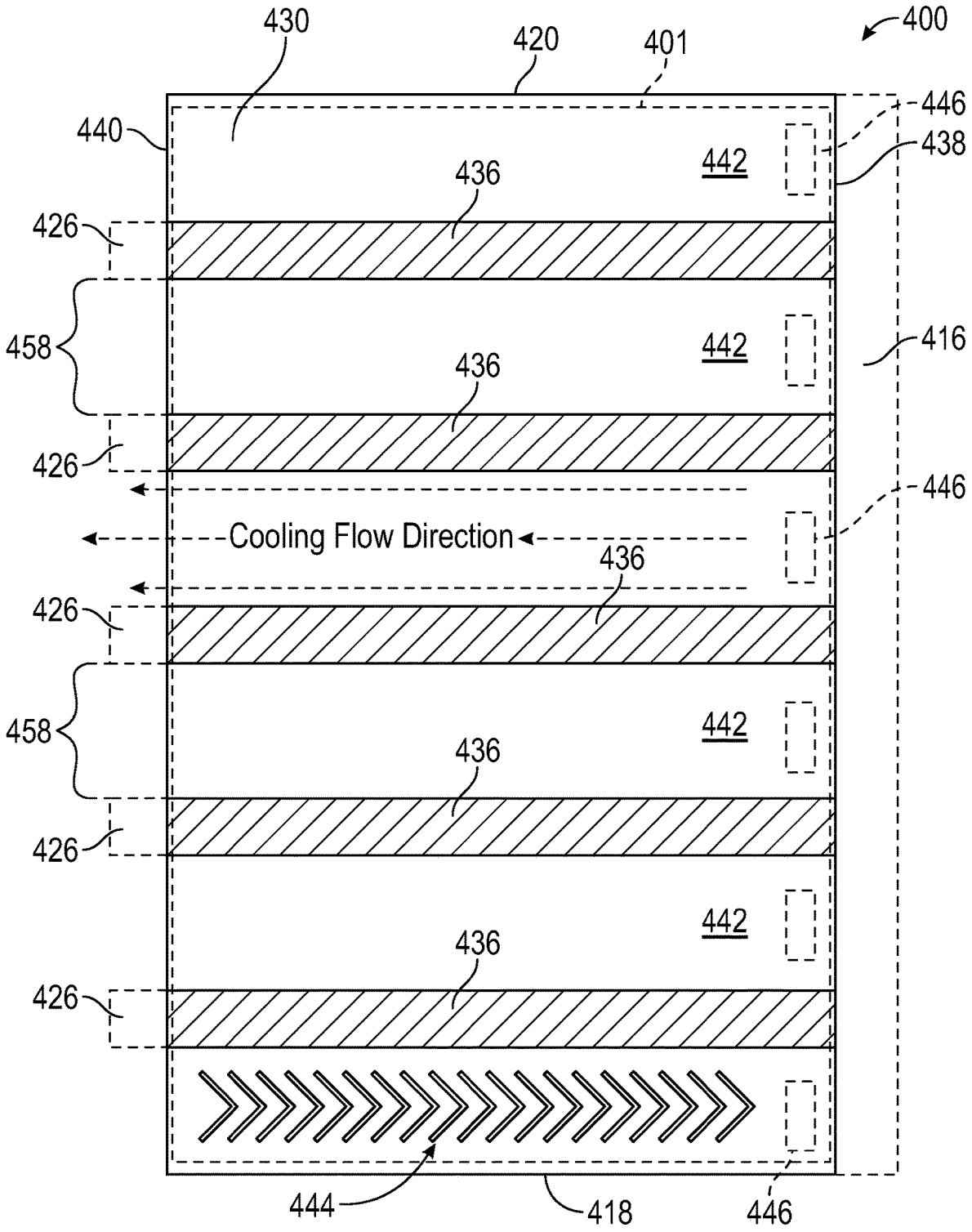
FIG. 4B illustrates an elevational view of a portion of an interior surface of a leading edge cavity of the airfoil of FIG. 4A, in accordance with an embodiment of the present disclosure.
Figures 4C, 4D:
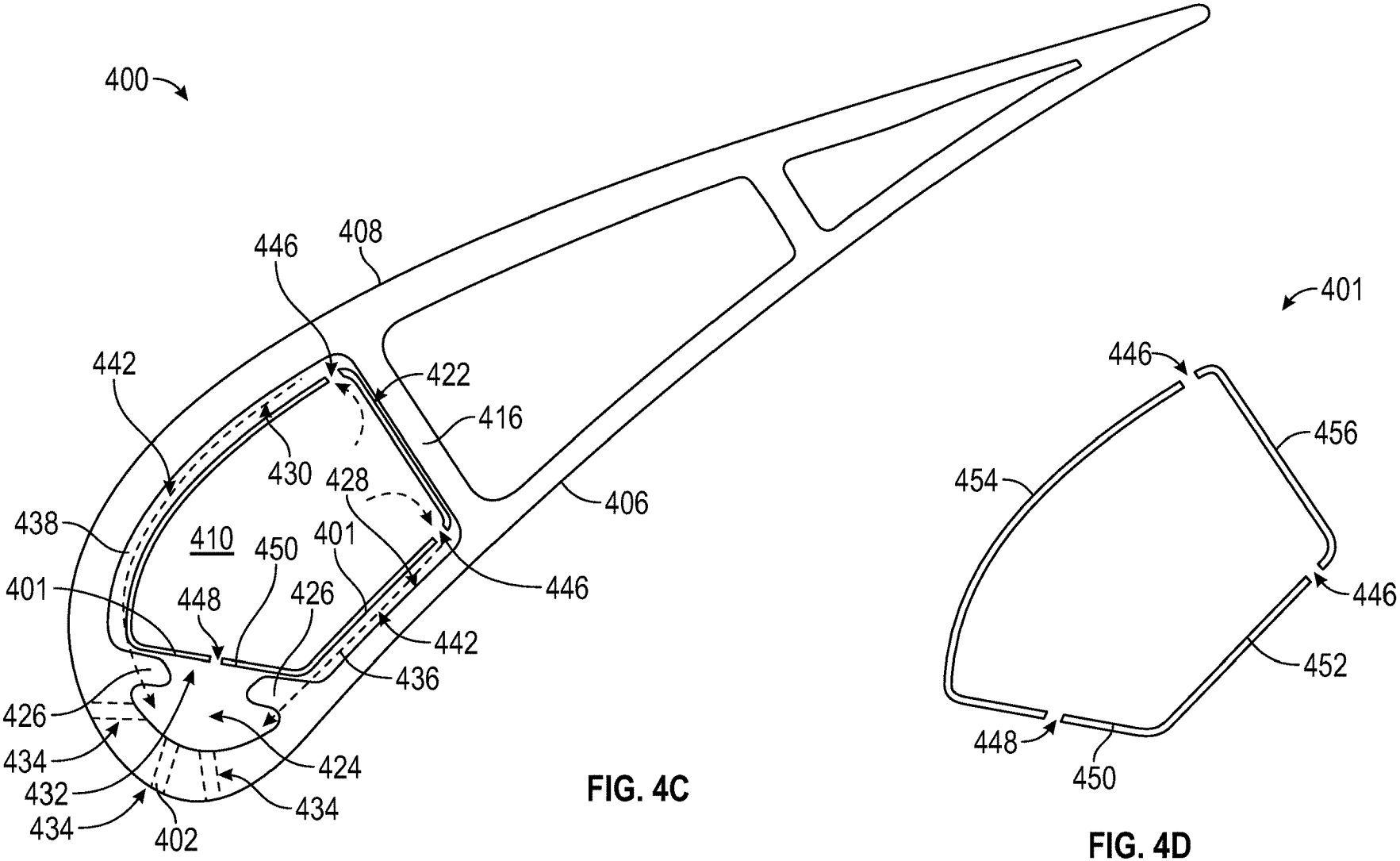
FIG. 4C illustrates the same top-down cross-sectional view of FIG. 4A, with a "space-eater" baffle installed within the leading edge cavity of the airfoil.
FIG. 4D illustrates the baffle of FIG. 4C, in accordance with an embodiment of the present disclosure, in isolation and not installed within the airfoil.

Turning to FIGS. 4A-4D, schematic illustrations of an airfoil 400 in accordance with an embodiment of the present disclosure is shown. FIG. 4A illustrates the airfoil 400 in a top-down cross-sectional view showing an interior structure of the airfoil 400. FIG. 4B illustrates an elevational view of a portion of an interior surface of a leading edge cavity of the airfoil 400. FIG. 4C illustrates the same top-down cross-sectional view of FIG. 4A, but with a "space-eater" baffle 401 installed within the cavity of the airfoil 400. FIG. 4D illustrates the "space-eater" baffle 401, in accordance with an embodiment of the present disclosure, in isolation, not installed within the airfoil 400. As described herein, the described cavity (e.g., leading edge cavity) may be a compound cavity having multiple different portions/regions/aspects. That is, the term "compound" with respect to a cavity within an airfoil, as used herein, refers to a cavity having multiple functions, regions, sub-cavities, etc. that are distinct from each other—but a single cavity formed within the airfoil. For example, the leading edge cavity of the airfoil 400 shown in FIGS. 4A-4D may be "compound" and include a leading edge portion and a baffle portion, with the baffle portion aft of the leading edge portion. Generally, the cavities described herein are cavities having multiple substantially distinct portions or regions (e.g., sub-cavities) that can provide different functions within the airfoil cooling configuration, such as to receive a baffle.

As shown in FIG. 4A, the airfoil 400 extends in a substantially axial direction between a leading edge 402 and a trailing edge 404. In a circumferential direction, as described above, the airfoil 400 extends between a pressure side 406 and a suction side 408. The airfoil 400 includes internal cavities that are configured to allow cooling air to enter and pass therethrough, for example, from a platform located at an inner or outer diameter location (e.g., as shown in FIG. 2). In this illustrative embodiment, the airfoil 400 includes a leading edge cavity 410, a midchord cavity 412, and a trailing edge cavity 414. One or more of the cavities 410, 412, 414 may be fluidly connected to allow cooling air to flow from one into another. However, in some embodiments, at least the leading edge cavity 410 may be fluidly separated from the other cooling cavities of the airfoil 400. The separation of the leading edge cavity 410 from the midchord cavity 412 may be provided by a separator rib 416 that extends from between an inner diameter 418 to an outer diameter 420 of the airfoil 400 (as shown in FIG. 4B) and between the pressure side 406 and the suction side 408. The separator rib 416 may provide structural support to the airfoil 400, may fluidly separate the cavities thereof, and may provide a support surface for supporting a baffle within the leading edge cavity 410.

The leading edge cavity 410 includes a baffle portion 422 and a leading edge portion 424. The baffle portion 422 is partially separated from the leading edge portion 424 by one or more support element retention features 426. The support element retention features 426 are located within the leading edge cavity and are arranged to partially separate the baffle portion from the leading edge portion. The support element retention features 426 extend between the pressure side and the suction side of the leading edge cavity. The support element retention features 426 are located within the leading edge cavity and are arranged to partially separate the baffle portion from the leading edge portion. The support element retention features 426 extend between the pressure side and the suction side of the leading edge cavity (i.e., circumferential direction). The baffle portion 422 is defined, in part, by a surface of the separator rib 416, a pressure side surface 428, and a suction side surface 430. The separator rib 416 defines an aft most portion of the leading edge cavity 410 and the location of the support element retention features 426 defines the forward most extent of the baffle portion 422. The support element retention features 426 may be discontinuous in the radial direction, allowing for fluid communication between the baffle portion 422 and the leading edge portion 424. Further, in the circumferential direction, the space between opposing support element retention features 426 may be referred to as an impingement portion 432 of the leading edge cavity 410. Forward of the impingement portion 432 is the leading edge portion 424 of the leading edge cavity 410. Air within the leading edge portion 424 may exit the leading edge cavity 410 through one or more film cooling holes 434 (e.g., showerhead and gill row holes) located on the leading edge 402 of the airfoil 400, as will be appreciated by those of skill in the art.

The baffle portion 422 of the leading edge cavity 410 is sized and shaped to receive a baffle, such as a space-eater baffle, therein. Further, the walls, and specifically the pressure side surface 428 and the suction side surface 430 that define the baffle portion 422 include one or more axial extending ribs 436, as shown in FIGS. 4A-4B. The axial extending ribs 436 extend between an aft end of the respective surface to a forward end of the respective surface. For example, as shown in FIG. 4B, the axial extending ribs 436 extend between an aft end 438 to a forward end 440 of the suction side surface 430. The separator rib 416 is located at and defines the aft end 438 and the support element retention features 426 are located at and define, in part, the forward end 440 of the axial extending ribs 436. Between adjacent axial extending ribs 436 (in the radial direction between the inner diameter 418 and the outer diameter 420) are defined one or more axial extending flow channels 442. The axial extending flow channels 442 are configured to allow a fluid flow, such as a cooling flow, tp pass therethrough. The surfaces of the axial extending flow channels 442 may be smooth or may include heat transfer augmentation features 444, shown schematically in one of the axial extending flow channels 442. The heat transfer augmentation features 444 may be, for example, discrete trip strips, pin fins, divots, pedestals, hemispherical protrusions, etc., as will be appreciated by those of skill in the art. It will be appreciated that the axial extending ribs 436 extend from the suction side surface 430 to define the axial extending flow channels 442. That is, the axial extending ribs 436 may extend in a circumferential direction off of the suction side surface 430 and into the baffle portion 422 of the leading edge cavity 410.

Turning now to FIGS. 4C-4D, the airfoil 400 is shown with the "space-eater" baffle 401 installed within the baffle portion 422 of the leading edge cavity 410. The "space-eater" baffle 401 is a space-eater baffle that is configured to provide a cooling flow of air into the airfoil 400, and specifically to provide cooling along hot walls (i.e., pressure side 406 and suction side 408 of the airfoil 400) along the leading edge cavity 410. Cooling flow enters in the middle of the "space-eater" baffle 401 (i.e., the interior portion of the "space-eater" baffle 401) from the vane inner diameter or outer diameter and exits out through one or more first metering flow apertures 446 into the axial extending flow channels 442 formed between the exteriors surface of the "space-eater" baffle insert and the axial extending rib offset features. The cooling flow will then pass into the leading edge portion 424 of the leading edge cavity 410 and is expelled out of leading edge portion 424 through the film cooling holes 434. Additionally, a portion of the air within the "space-eater" baffle 401 may flow directly into the leading edge portion 424 through one or more impingement apertures 448 formed on/in a leading edge or forward wall 450 of the "space-eater" baffle 401. When the "space-eater" baffle 401 is installed within the airfoil 400, the axial extending flow channels 442 are defined between exterior surfaces of the "space-eater" baffle 401 and interior surfaces of the airfoil 400 (i.e., pressure side surface 428 and suction side surface 430).

As shown in FIGS. 4C-4D, the "space-eater" baffle 401 includes the forward wall 450, a pressure side wall 452, a suction side wall 454, and an aft wall 456. When installed within the airfoil 400, the pressure side wall 452 of the "space-eater" baffle 401 is arranged along and adjacent or proximate the pressure side surface 428 of the leading edge cavity 410 along the pressure side 406 of the airfoil 400. Similarly, the suction side wall 454 of the "space-eater" baffle 401 is arranged along and adjacent or proximate the suction side surface 430 of the leading edge cavity 410 along the suction side 408 of the airfoil 400. The aft wall 456 of the "space-eater" baffle 401 is arranged in contact with or proximate to and adjacent the separator rib 416 of the airfoil 400. At the forward end the forward wall 450 of the "space-eater" baffle 401 contacts the support element retention features 426. Accordingly, the "space-eater" baffle 401 is retained in a forward-aft direction between the support element retention features 426 and the separator rib 416.

As shown in FIG. 4D, the first metering flow apertures 446 are formed in the pressure side wall 452 and the suction side wall 454 of the "space-eater" baffle 401 proximate the aft wall 456. As such, air exiting the interior of the "space-eater" baffle 401 will enter the axial extending flow channels 442 proximate the aft wall 454 and subsequently flow in a forward direction toward the leading edge 402 of the airfoil 400. Furthermore, the impingement apertures 448 are formed in the forward wall 450 of the "space-eater" baffle 401, and air can impinge through the impingement apertures 448 and enter the leading edge portion 424 of the airfoil 400, and may impinge directly upon the leading edge hot wall of the airfoil 400. The impingement apertures 448 are aligned with the impingement portion 432 defined between the support element retention features 426.

The support element retention features 426 provide support and positioning for the "space-eater" baffle 401 as described above. Further, the support element retention features may control a flow entering the leading edge portion 424 of the leading edge cavity 410. For example, the support element retention features 426 may define second metering flow apertures 458, as shown in FIG. 4B (isometric illustration of a similar concept shown, for example, in FIG. 5, below). In operation, the first metering flow apertures 446 define an upstream or inlet end of a given axial extending flow channel 442 and the second metering flow apertures 458 define a downstream or outlet end of the given axial extending flow channel 442. As such, as noted above, the axial extending flow channels 442 define forward flowing channels with an inlet of air at the aft end 438 of the respective axial extending flow channel 442 and an outlet of air at the forward end 440 of the respective axial extending flow channel 442.

Although the support element retention features 426 shown in FIG. 4B are the same radial height as the axial extending ribs 436, such configuration is not to be limiting. The support element retention features 426, in some embodiments, may be integral with the axial extending ribs 436. In some embodiments, the support element retention features 426 may be configured and defined in order to achieve the necessary flow distribution and pressure loss characteristics within each of the axial extending flow channels 442. The flow area size, shape, fillet blends, surface contours, and spacing of the second metering flow apertures 458 may be independently configured and customized depending on local external heat load and cooling effectiveness requirements for a given airfoil or application. Further, the geometry of the support element retention features 426 (e.g., height, width, length) may be tailored to optimize local conduction and fin efficiency. The support element retention features 426 may also incorporate a variable taper depending on structural load and core die manufacturing requirements to mitigate die lock and die pull constraints.

As noted above, and shown in FIG. 4B, the side surfaces 428, 430 can include heat transfer augmentation features 444 within the axial extending flow channels 442. In some embodiments, the heat transfer augmentation features 444 may continue along the interior surfaces of the airfoil 400 into the leading edge portion 424. In some embodiments, the interior surface of the leading edge portion 424 of the leading edge cavity 410 can include distinct or separate heat transfer augmentation features from those within the axial extending flow channels 442. For example, in one non-limiting embodiment, the axial extending flow channels 442 may include chevron-type trip strips and the leading edge portion 424 can include divots or discrete hemispherical protrusion type heat transfer augmentation features. Various other configurations are possible without departing from the scope of the present disclosure.

Turning now to FIG. 5, a schematic illustration of a portion of an airfoil 500 and a "space-eater" baffle 501 in accordance with an embodiment of the present disclosure is shown. FIG. 5 illustrates the "space-eater" baffle 501 separate from the airfoil 500.

The airfoil 500 has a leading edge 502, with pressure and suction sides extending aftward therefrom, as appreciated by those of skill in the art, and shown and described above. In this partial view, a portion of a suction side 508 proximate the leading edge 502 is shown. The airfoil 500 includes a leading edge cavity, as shown and described above, for receiving the "space-eater" baffle 501. The airfoil 500 receives the "space-eater" baffle 501 between a separator rib 516 and a plurality of support element retention features 526. Forward of the support element retention features 526, and defined at or along the leading edge 502, is a leading edge portion of the leading edge cavity, as shown and described above. It will be appreciated that the cavities of the airfoil 500 are not labeled for clarity of illustration, but are substantially similar to that shown and described above with respect to FIGS. 4A-4D.

As shown, the airfoil 500 includes a plurality of axial extending ribs 536. The axial extending ribs 536 extend between the separator rib 516 and the support element retention features 526. Between radially adjacent, axial extending ribs 536 are defined axial extending flow channels 542. The axial extending flow channels 542 may be channels extending from the separator rib 516 to the support element retention features 526 and may fluidly connect to the leading edge portion of the leading edge cavity through second metering flow apertures 558, which define a downstream end of the axial extending flow channels 542. Located at the upstream end of the axial extending flow channels 542 are first metering flow apertures 546, which are illustratively shown relative to the axial extending flow channels 542 but are physically defined (and shown) by the "space-eater" baffle 501 in FIG. 5. The surfaces of the airfoil 500 that define the axial extending flow channels 542 between the axial extending ribs 536 may optionally, and as shown, include heat transfer augmentation features 544. The illustrative heat transfer augmentation features 544 are shown as chevron-type trip strips, but other types of heat transfer augmentation features may be employed without departing from the scope of the present disclosure.

As depicted in FIG. 5, the axial extending ribs 536 may be defined to have a variable height along the axial extending flow channels 542. The height of the axial extending ribs 536 is defined in a direction between pressure and suction side walls of an airfoil (e.g., circumferential, as defined in FIG. 2, when installed in a turbine engine). The height of the axial extending ribs 536, in this configuration, increases in the streamwise direction (i.e., axial direction) from the separator rib 516, proximate the first metering flow aperture 546, to the support element retention features 526, proximate the second metering flow apertures 558, which defines the downstream end of the axial extending flow channels 542. As shown, the axial extending ribs 536 have an aft-end rib height $H_a$ and a forward-end rib height $H_f$, with the aft-end rib height $H_a$ being less than the forward-end rib height $H_f$, resulting in an axially increasing rib height. The increase in the height of the axial extending ribs 536 increases the cross-sectional flow area of the axial extending cooling channels 542. This increase in cross-sectional flow area causes a diffusion of the cooling flow. As such the Mach number in the streamwise direction along the axial extending flow channels 542 and the Reynolds number and convective heat transfer, in the streamwise flow direction, will be decreased. The variation in the height of the axial extending ribs 536 enables the local heat transfer, cooling air heat pickup, and pressure loss to be tailored to match local variations in the external airfoil heat flux.

Figure 7A:
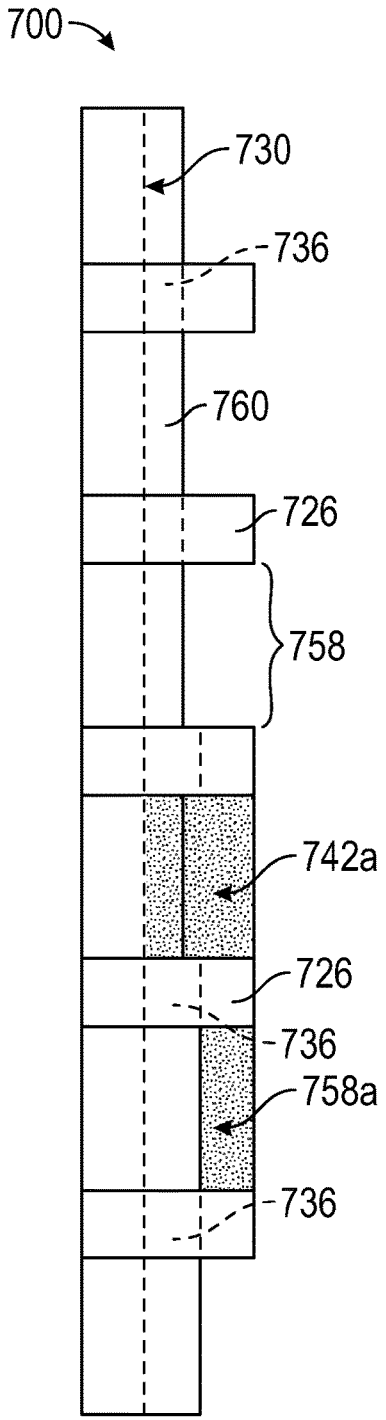
FIG. 7A is a first elevational illustration of a portion of an airfoil in accordance with an embodiment of the present disclosure.
Figure 7B:
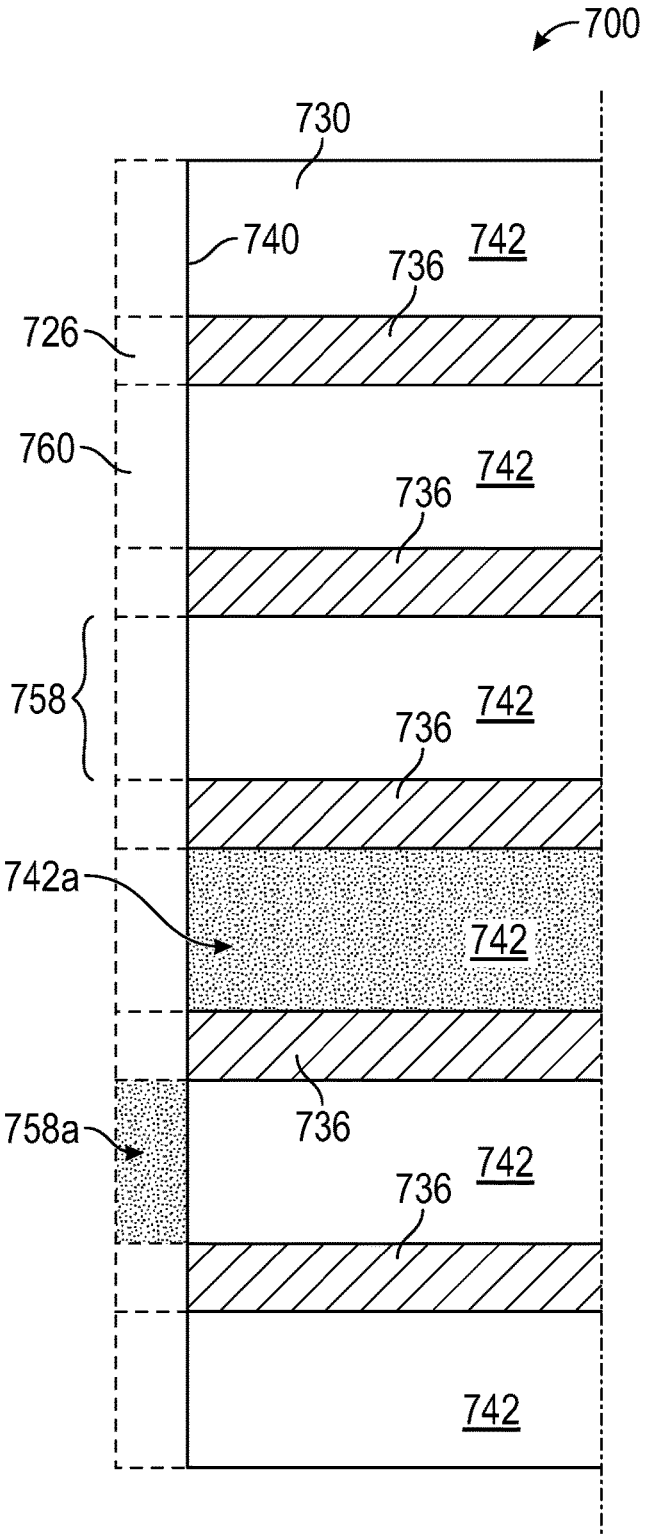
FIG. 7B is a second elevational illustration of the portion of the airfoil shown in FIG. 7A.
Figure 7C:
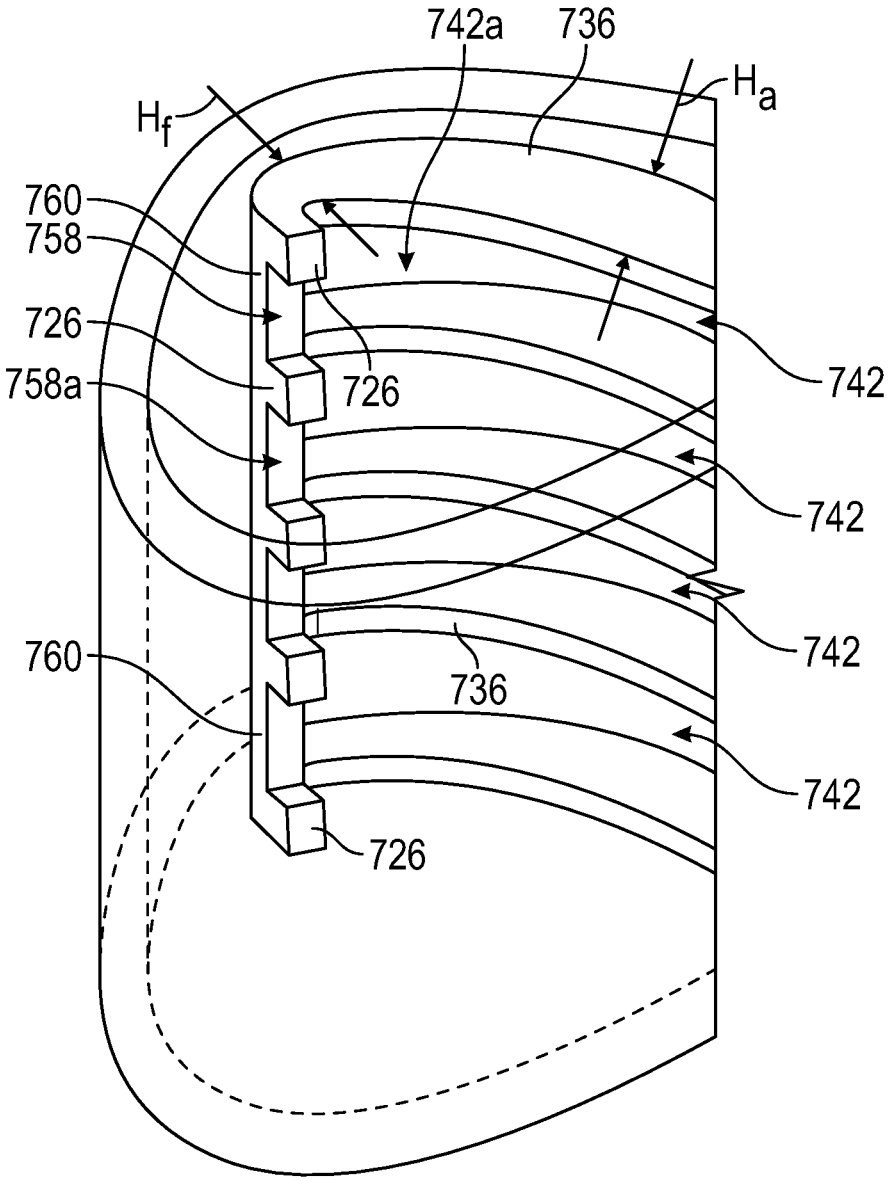
FIG. 7C is a schematic partial isometric illustration of the airfoil shown in FIG. 7A.

Conversely, in an alternative embodiment, the height of the axial extending ribs 536 may decrease in the streamwise direction from the separator rib 516, proximate the first metering flow aperture 546, to the support element retention features 526, proximate the second metering flow apertures 558 (e.g., as shown in FIG. 7C). The decrease in the rib height of the axial extending ribs 536 reduces the cross-sectional flow area of the axial extending cooling channels 542. This decrease in cross-sectional area will cause an acceleration of the cooling flow, thereby increasing the Mach number and internal Reynolds number and convective heat transfer in the streamwise flow direction.

The "space-eater" baffle 501 includes a forward wall 550, a pressure side wall 552, a suction side wall 554, and an aft wall 556. The walls 550, 552, 554, 556 define an interior baffle cavity, as will be appreciated by those of skill in the art. The "space-eater" baffle 501 includes the first metering flow apertures 546 located proximate the aft wall 556 and within or on the pressure side wall 552 and the suction side wall 554. The first metering flow apertures 546 are arranged to align with the axial extending flow channels 542 when the "space-eater" baffle 501 is installed within the airfoil 500, and as illustratively shown in FIG. 5. The "space-eater" baffle 501 further includes one or more impingement apertures 548 formed on/in the forward wall 550 of the "space-eater" baffle 501.

Although the first and second metering flow apertures and the impingement apertures are illustratively shown as rectangular and/or elongated, such illustrative geometry is not to be limiting, but rather for example purposes only. Any geometry, including, without limitation, circular, oval, square, and/or rectangular may be employed without departing from the scope of the present disclosure.

Figure 6A:
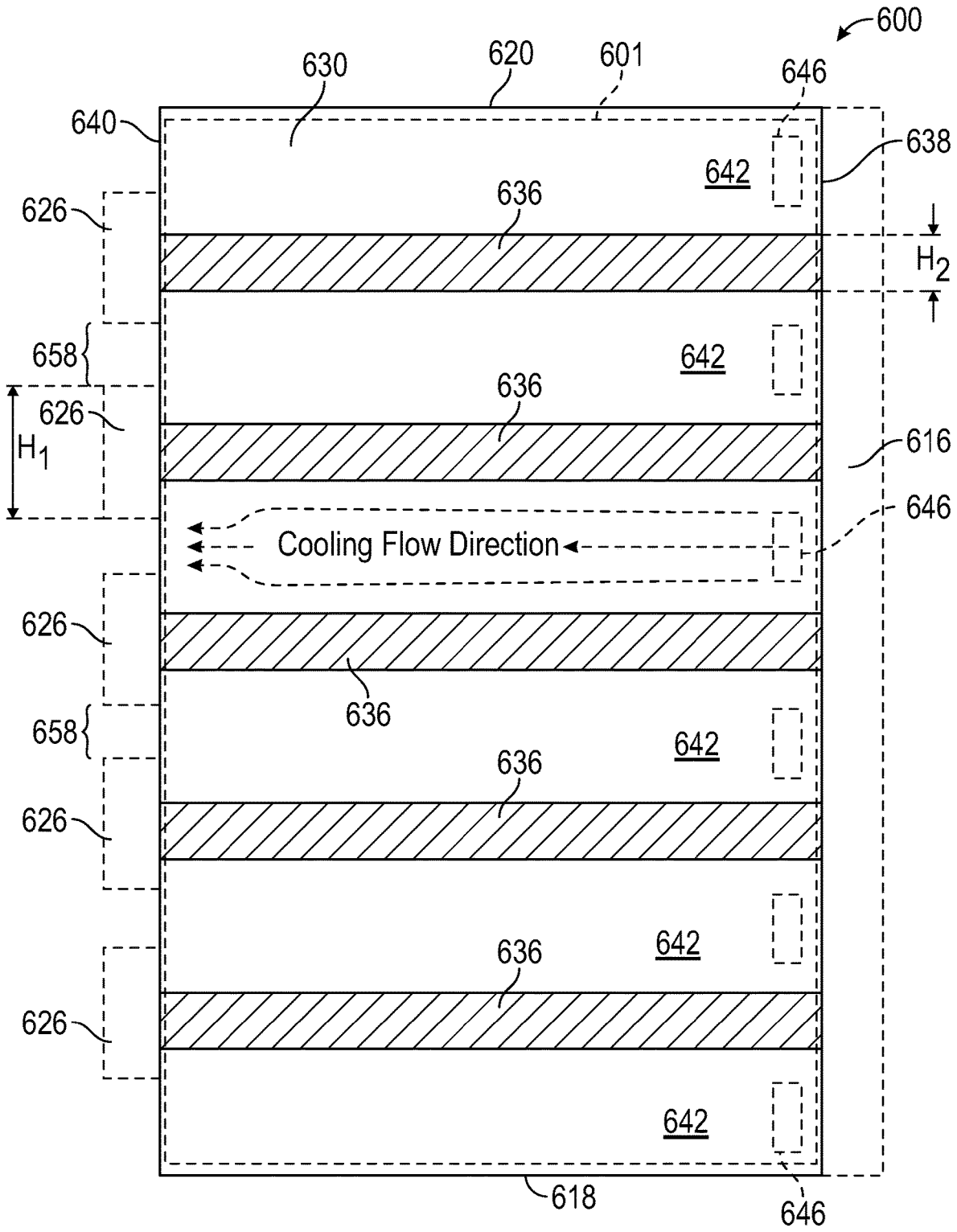
FIG. 6A is an elevational schematic illustration of a portion of an airfoil in accordance with an embodiment of the present disclosure.
Figure 6B:
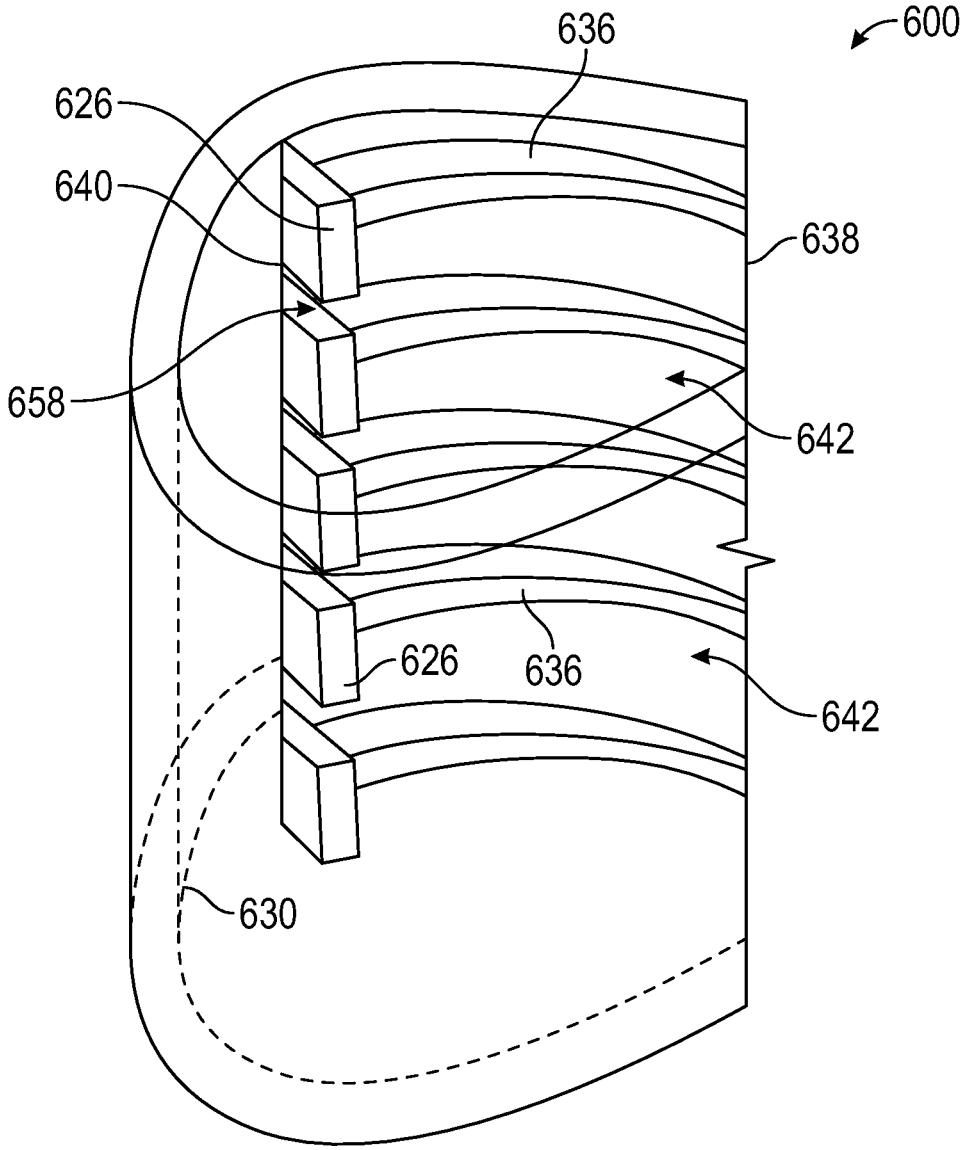
FIG. 6B is a partial isometric illustration of a portion of the airfoil shown in FIG. 6A.

Turning now to FIGS. 6A-6B, schematic illustrations of a portion of an airfoil 600 in accordance with an embodiment of the present disclosure is shown, with FIG. 6A being a partial elevation view and FIG. 6B being a partial isometric view. The airfoil 600 may be substantially similar to that shown and described above. For example, the airfoil 600 is arranged having a leading edge cavity configured to receive a baffle in a baffle portion thereof. The airfoil 600 includes a separator rib 616 at an aft end of the leading edge cavity. Along pressure and suction side walls of the airfoil 600 that define portions of the leading edge cavity are axial extending ribs 636. The axial extending ribs 636 extend between an aft end of the respective surface to a forward end of the respective surface. For example, as shown in FIGS. 6A-6B, the axial extending ribs 636 extend between an aft end 638 to a forward end 640 of a suction side surface 630. The separator rib 616 is located at and defines the aft end 638 and one or more support element retention features 626 are located at the forward most end of the axial extending ribs 636 and define, in part, the forward end 640 of the axial extending ribs 636. Between adjacent axial extending ribs 636 (in the radial direction between an inner diameter 618 and an outer diameter 620) are defined axial extending flow channels 642.

The axial extending flow channels 642 are configured to allow fluid flow, such as a cooling flow, to pass therethrough. The surfaces of the axial extending flow channels 642 may be smooth or may include heat transfer augmentation features, as described above. It will be appreciated that the axial extending ribs 636 extend from the suction side surface 630 to define the axial extending flow channels 642. That is, the axial extending ribs 636 may extend in a circumferential direction off of the suction side surface 630 and into the baffle portion of the leading edge cavity, as described above.

In this illustrative embodiment, the support element retention features 626 are arranged to provide metering of flow at the outlet or forward end 640 of the axial extending flow channels 642. That is, second metering flow apertures 658 defined between radially adjacent support element retention features 626 are illustratively radially shorter or smaller than that shown in FIG. 4B. This is achieved because the radial height $H_1$ of the support element retention features 626 is greater than the radial height $H_2$ of the axial extending ribs 636. Stated another way, the radial height of the axial extending flow channels 642 is greater than the radial height of the second metering flow apertures 658. This configuration can enable an impingement-type cooling flow through the second metering flow apertures 658, which can impinge upon hot wall surfaces at the leading edge of the airfoil 600. Such configurations can provide increased heat transfer augmentation on both the internal surface of the leading edge of the airfoil within the leading edge portion of the leading edge cavity. Additionally, such configurations may provide for enhanced heat transfer at the inlet of the leaded edge showerhead film cooling holes that emanate from the leading edge portion of the leading edge cavity due to the impinging flow effects created by the discrete flow jets provided by the discrete flow apertures 658.

Cooling flow enters the axial extending flow channels 642 through one or more first metering flow apertures 646 of a "space-eater" baffle 601 into the axial extending flow channels 642. Due to the increased height $H^1$ at the support element retention features 626, the cooling flow will be funneled or otherwise converge upon the relatively narrow second metering flow apertures 658, as shown in FIG. 6.

Turning now to FIGS. 7A-7B, schematic illustrations of a portion of an airfoil 700 in accordance with an embodiment of the present disclosure are shown. The airfoil 700 may be substantially similar to that shown and described above. For example, the airfoil 700 is arranged having a leading edge cavity configured to receive a baffle in a baffle portion thereof. FIG. 7A is an elevation illustration of a portion of the airfoil 700 viewed in a direction from a leading edge toward a trailing edge of the airfoil 700, viewing along a suction side of the airfoil 700. FIG. 7B is an elevation illustration of the airfoil 700 as viewing the suction side interior surface proximate a leading edge of the airfoil 700. FIG. 7C is a schematic partial isometric illustration of the airfoil shown in FIG. 7A

The airfoil 700 includes a separator rib at an aft end of the leading edge cavity (e.g., similar to that shown in FIGS. 5, 6A, 6B). Along pressure and suction side walls of the airfoil 700 that define portions of the leading edge cavity are axial extending ribs 736. The axial extending ribs 736 extend between an aft end of the respective surface to a forward end of the respective surface. For example, the axial extending ribs 736 extend between an aft end (not shown) to a forward end 740 of a suction side surface 730 of the airfoil 700. The support element retention features 726 are located at and define, in part, the forward end 740 of the axial extending ribs 736. The support element retention features 726 are located at the forward most end of the axial extending ribs 736. Between adjacent axial extending ribs 736 (in the radial direction) are defined one or more axial extending flow channels 742.

In this embodiment, the support element retention features 726 include metering elements 760 extending in a radial direction between radially adjacent support element retention features 726. The support element retention features 726 and the metering elements 760 may be integral portions or part of the airfoil 700 and extend in a circumferential direction (i.e., away) from the suction side surface 730. The metering elements 760 of the support element retention features 726 define, in part, second metering flow apertures 758 that restrict a flow cross-sectional area at the outlet or forward end of the axial extending flow channels 742. For example, as shown in FIGS. 7A-7C, a cross-sectional area 742*a* of the axial extending flow channels 742 is shown as larger than a cross-sectional area 758*a* of the second metering flow apertures 758. As illustratively shown, the axial extending ribs 736 have a greater height relative to the suction side surface 730 than the height of the metering elements 760 and less than the height of the support element retention features 726.

As depicted in FIG. 7C, in this configuration, the axial extending ribs 736 may be defined to have a variable height along the axial extending flow channels 742. The height of the axial extending ribs 736 is defined in a direction between pressure and suction side walls of an airfoil (e.g., circumferential, as defined in FIG. 2, when installed in a turbine engine). The height of the axial extending ribs 736, in this configuration, decreases in the streamwise direction (i.e., axial direction) from the separator rib at the aft end to the support element retention features 726 at the forward end. As shown, the axial extending ribs 736 have an aft-end rib height $H_a$ and a forward-end rib height $H_f$, with the aft-end rib height $H_a$ being greater than the forward-end rib height $H_f$, resulting in an axially decreasing rib height. The decrease in the height of the axial extending ribs 736 decreases the cross-sectional flow area of the axial extending cooling channels 742.

Figure 8:
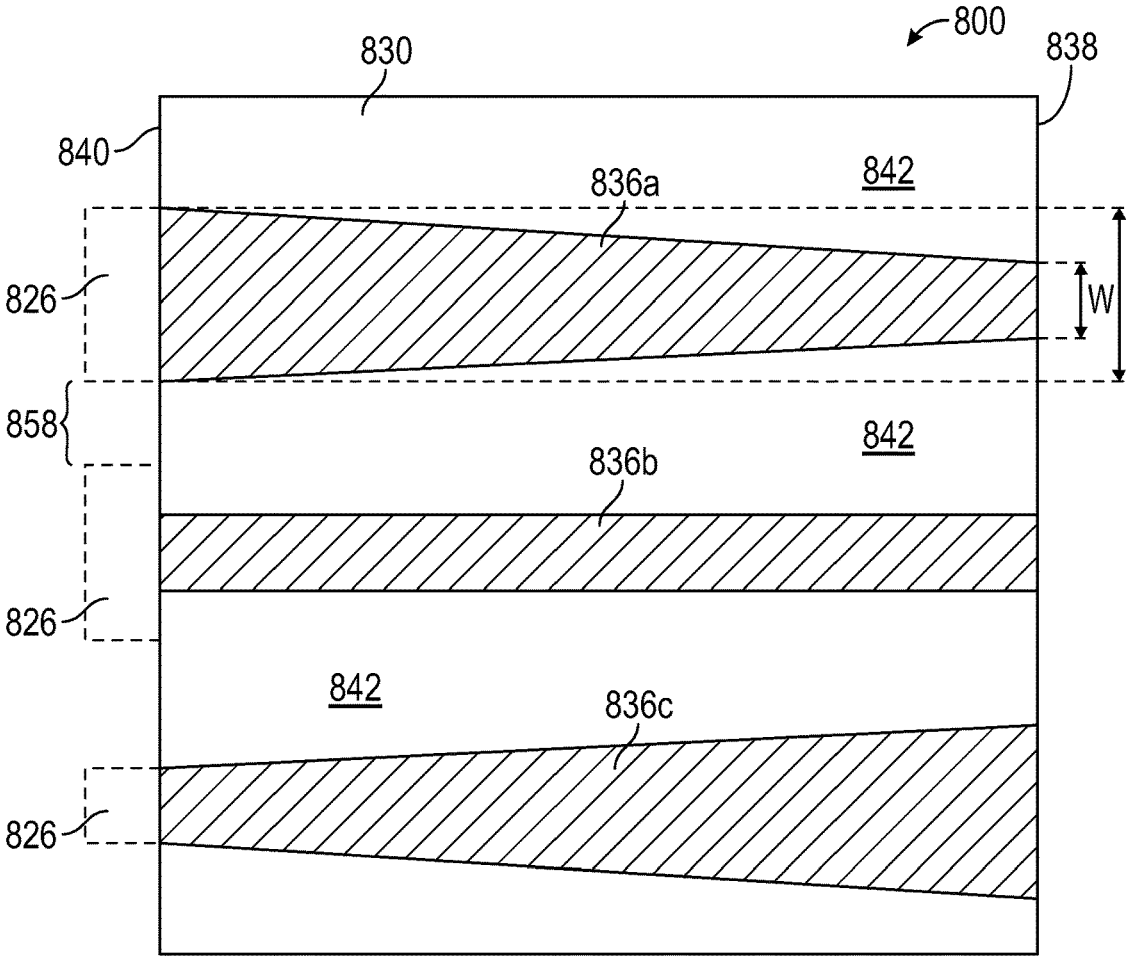
FIG. 8 is a schematic illustration of different types of axial extending ribs that may be employed in various embodiments of the present disclosure.

Turning now to FIG. 8, a schematic illustration of a suction side surface 830 of an airfoil 800 in accordance with an embodiment of the present disclosure is shown. In this illustrative configuration, the airfoil 800 includes three different configurations or styles of axial extending ribs in accordance with embodiments of the present disclosure. Incorporating variable rib widths may be implemented to address local airfoil stress, strain and/or panel bulge creep issues.

In some configurations, the tailoring of the internal axial flow area may be limited due to local thermal hot spots that can result from poor thermal fin efficiency related to unfavorable geometric aspect ratios of the axial extending ribs. Low H/W (height-to-width) ratios of the axial extending ribs can result in reduced local cooling effectiveness, resulting from lower convective heat transfer and increased conduction resistance due to the relatively large thermal mass associated with a poor fin efficiency design. A rib height (e.g., circumferential dimension, or distance extending from a hot wall) and/or a rib width (e.g., radial thickness) may be set to achieve a desired cooling. For example, as discussed above, the embodiment shown with respect to FIG. 5 illustrates tapering of the height H of the axial extending rib along the streamwise axial direction. FIG. 8 illustrates width configurations. It will be appreciated that both height and width may be defined for a specific purpose.

By linearly increasing or decreasing the height H of the axial extending rib, the flow area of the axial channels can be tailored to better manage the cooling air heat pickup, pressure loss, and internal convective heat transfer distribution in order to mitigate variations in external heat flux and gas temperature along the airfoil surface. In this sense, the local metal temperature, through-thickness, and in-plane thermal gradients in both the axial and radial directions along the airfoil surface can be minimizes to improve both oxidation and thermal mechanical fatigue failure modes.

With respect to a rib width (i.e., radial dimension), and turning to FIG. 8, a first axial extending rib 836*a* is arranged having a widening taper in rib width W extending from an aft end 838 to a forward end 840 and defining a wall or side of an axial extending flow channel 842. The first axial extending rib 836*a* widens in the radial rib width Win a direction toward the leading edge of the airfoil 800 (i.e., in a direction from the aft end 838 to the forward end 840). A second axial extending rib 836*b* is shown having a constant radial width from the aft end 838 to the forward end 840. A third axial extending rib 836*c* is shown having a narrowing radial width in the direction from the aft end 838 to the forward end 840. Also, as shown, support element retention features 826 can take complimentary dimensions or may be different in dimension from the forward end of a respective axial extending rib. Although shown as a mix of different axial extending rib styles, a given airfoil may be arranged having all of a single or complimentary type, to enable a desired cooling flow through axial extending flow channels, with either narrowing, widening, or constant radial width channels in a direction from aft end to forward end.

Figure 9:
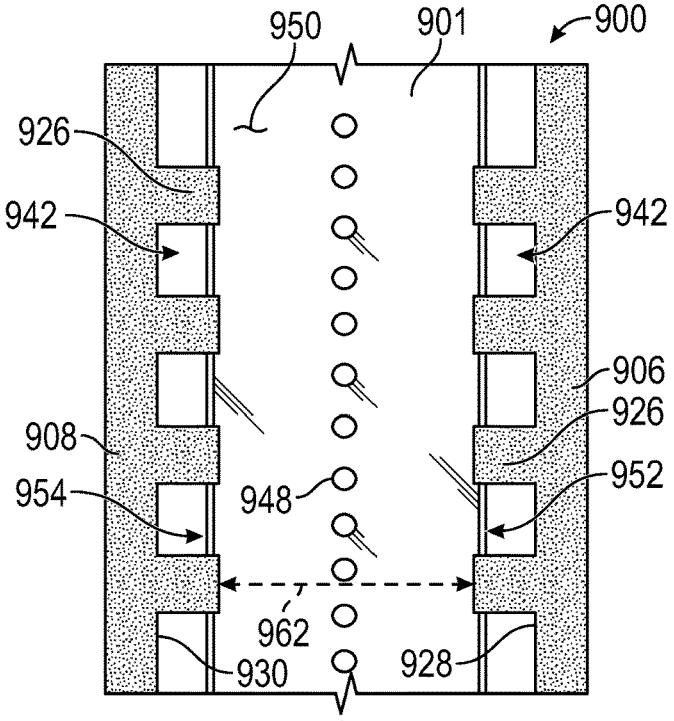
FIG. 9 is a schematic elevational illustration of a baffle installed within an airfoil in accordance with an embodiment of the present disclosure.

FIG. 9 illustrates a partial elevation view of a portion of an airfoil 900 having a baffle 901 installed therein, in accordance with an embodiment of the present disclosure. The arrangement of the airfoil 900 and the baffle 901 may be substantially similar to that shown and described above. The baffle 901 is arranged within the airfoil 900 and supported at a forward end by support element retention features 926 that extend from a pressure side 906 and a suction side 908 of the airfoil 900. As described above, the support element retention features 926 extend into a leading edge cavity defined at the leading edge of the airfoil 900. The baffle 901 is configured to form axial extending flow channels 942 between axial extending ribs (not visible in this view), a suction side surface 930, a pressure side surface 928, a pressure side wall 952 of the baffle 901, and a suction side wall 954 of the baffle 901.

As shown, the pressure side wall 952 and the suction side wall 954 of the baffle 901 are arranged to contact or engage with the support element retention features 926 at the forward end of the baffle 901. A forward wall 950 extends in a direction from the pressure side to the suction side (or circumferentially; left-right in FIG. 9) between the pressure side wall 952 and the suction side wall 954 of the baffle 901. The forward wall 950 defines a wall of the baffle 901 and, when installed within the airfoil 900, defines the forward most wall of the baffle 901 (i.e., closest to a leading edge of the airfoil 901). The forward wall 950 can define, in part, a portion of a leading edge portion of the leading edge cavity. As shown, a series of impingement apertures 948 are formed on/in the forward wall 950 of the baffle 901. The impingement apertures 948 enable air from within the baffle 901 to impinge into the leading edge portion of the leading edge cavity.

As shown, the support element retention features 926 are separated by a circumferential gap 962. As such, the support element retention features 926 do not span the full extent between the suction side surface 930 and the pressure side surface 928. Such circumferential gap 962 may reduce the weight of the airfoil 900, while providing for support and positioning of the baffle 901 within the airfoil 900.

Figure 10:
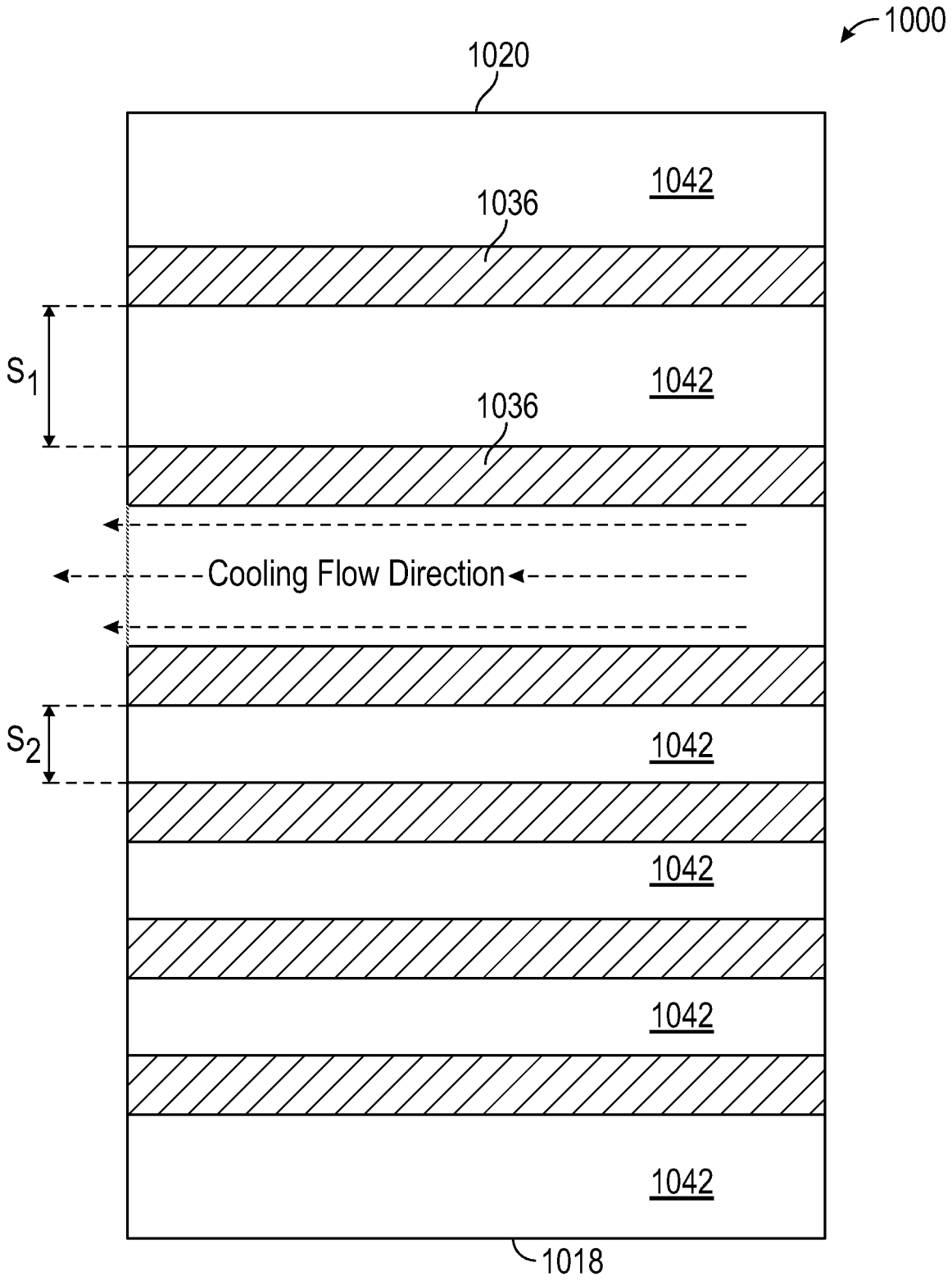
FIG. 10 is a schematic illustration of an axial extending rib configuration in accordance with an embodiment of the present disclosure.

Turning now to FIG. 10, a schematic illustration of a portion of an airfoil 1000 in accordance with an embodiment of the present disclosure is shown. The airfoil 1000 may be substantially similar to that shown and described above. For example, the airfoil 1000 is arranged having a leading edge cavity configured to receive a baffle in a baffle portion thereof. The airfoil 1000 includes, along pressure and suction side walls of the airfoil 1000, axial extending ribs 1036. The axial extending ribs 1036 extend between an aft end of the respective surface to a forward end of the respective surface, as shown and described above. In this illustrative embodiment, the axial extending ribs 1036 are not evenly or equally distributed in a radial direction between an inner diameter 1018 and an outer diameter 1020. As shown, some of the axial extending ribs 1036 may be separated by a first radial separation distance $S_1$ and other axial extending ribs 1036 may be separated by a second radial separation distance $S_2$. As shown, the first radial separation distance $S_1$ is greater than the second radial separation distance $S_2$. The disclosed configuration of this embodiment may be combined with other features, such as variable heights, variable width, etc. as shown and described herein.

Although shown illustratively as having the axial extending ribs oriented in substantially parallel arrangements, such configurations are not to be limiting, but are rather provided for illustrative and explanatory purposes. In some embodiments of the present disclosure, the ribs may not be purely axial and may vary spatially relative to any rib in order to create a passage width that is converging, diverging, and/or both converging and diverging. It will be appreciated that the ribs of such configurations will have a substantially axial extend or direction, but the structure an orientation is not limited to only axial in extent. That is, the illustrative embodiments are merely provided for explaining the functionality of the ribs and are not intended to be limiting on the structure, orientation, relative configurations, geometries, shapes, sizes, etc., as will be appreciated by those of skill in the art in view of the teachings provided herein.

Figure 11:
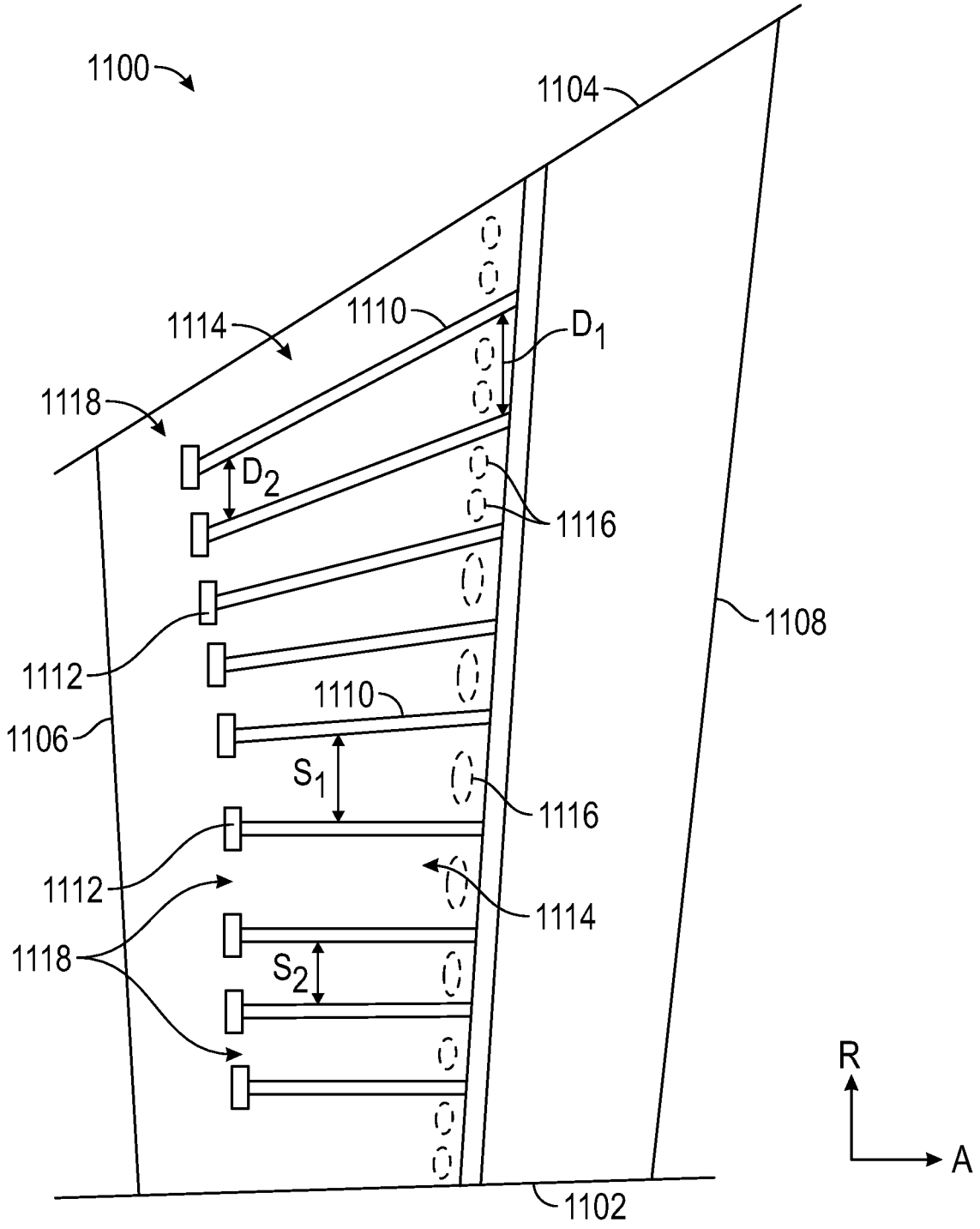
FIG. 11 is a schematic illustration of an airfoil having axial extending ribs in accordance with an embodiment of the present disclosure.

For example, turning now to FIG. 11, a schematic illustration of an airfoil 1100 in accordance with an embodiment of the present disclosure is shown. The airfoil 1100 extends in a radial direction R between an inner diameter 1102 and an outer diameter 1104 and between a leading edge 1106 and a trailing edge 1108 in an axial direction A. As shown, the outer diameter 1104 of the airfoil 1100 may not be parallel to the inner diameter 1102, as may be used for some airfoils within gas turbine engines. The airfoil 1100 includes internal cavities, such as shown and described above. The interior surfaces of at least one of the internal cavities includes axial extending ribs 1110 and associated support element retention features 1112, as shown and described above.

In this embodiment, the axial extending ribs 1110 are not purely axial along the axial direction A, but rather may be angled relative to the axial direction A, but have a general axial extent. The axial extending ribs 1110 may be evenly or unevenly distributed in the radial direction and may be separated by different radial separation distances $S_1$, $S_2$, etc. (e.g., constant separation distance along axial length) or may have varying radial separation distances $D_1$, $D_2$ (along axial length) between two radially adjacent axially extending ribs 1110, as shown. As such, the axial extending ribs 1110 define different configurations of axial extending flow channels 1114 therebetween. The axial extending flow channels 1114 define flow paths for cooling air from first metering flow apertures 1116 (in a "space-eater baffle") at an aft end and second metering flow apertures 1118 at a forward end. As shown in this embodiment, the axial extending flow channels 1114 may be configured with multiple associated first metering flow apertures 1116 that supply cooling air into the axial extending flow channels 1114.

The configuration shown in FIG. 11 illustrates that the axial extending ribs do not need to be purely parallel to an engine axis, or even parallel to each other. That is, the beginning and ends of the axial extending ribs may not be at a single radial position (e.g., relative to the inner diameter 1102 of the airfoil 1100), and may not span a single constant radius position. Further, in some embodiments, the axial extending ribs may be fanned, such that no two axial extending ribs are parallel (or some subset comprises a non-parallel set). Accordingly, configurations implementing the features illustrated in FIG. 11 can enable control of streamwise channel flow area (e.g., defined in part by separation distances $D_1$, $D_2$). The control of the streamwise channel flow area may also be controlled by varying the rib height (e.g., as shown in FIG. 5 and/or FIG. 7C). Furthermore, the relative pitch or separation distances $S_1$, $S_2$ of the axially extending ribs 1110 may be unique and/or varying depending on local external heatload and backside heat transfer, cooling flow, cooling air temperature heat pickup, and pressure loss requirement. Furthermore, the support element retention features 1112 do not have to be aligned linearly (e.g., along a single radii through the airfoil 1100 in a direction between the inner diameter 1102 and the outer diameter 1104) and may be offset in a monotonically or curvilinear with no inflections from any adjacent "space-eater" baffle retention feature 1112, to ensure "space-eater" baffle insertion and contact along each of the support element retention features 1112.

Advantageously, embodiments described herein provide for improved cooling schemes for airfoils. In accordance with embodiments of the present disclosure, airfoils, such as vanes for gas turbine engines, may be formed to receive a baffle and be arranged to have forward flowing cooling flow proximate the leading edge of the airfoil. In some embodiments, airfoils incorporate a leading edge "space-eater" baffle arranged adjacent segregated axial extending ribs to form axial (and forward) flowing cooling channels. Advantageously, in accordance with various embodiments of the present disclosure, an axial channel flow area in the axial streamwise direction may be constant, converging, diverging, or combinations thereof, with such flow area controlled by variable rib heights or widths.

In accordance with some embodiments of the present disclosure, a "space-eater" baffle is provided to form a counter-flow cooling concept in which a high pressure feed source can be optimally leveraged by managing pressure losses within a cooling system in order to provide more efficient and effective use of cooling airflow for improved convective and film cooling of a vane airfoil. Advantageously, in accordance with some design concepts of the present disclosure, a larger inlet feed may be incorporated along the outer diameter of a leading edge rail to mitigate plugging caused by internal sources (e.g., compressor rub strip material, blade outer air seal coating, w-seal/brush seal material, etc.) and external environmental sources (e.g., dirt, sand, debris, etc.). Further, advantageously, optimization of pressure loss may be achieved through various heat transfer augmentation features and orifices within the system.

Features that may be incorporated into embodiments of the present disclosure may include, but are not limited to, leading edge "space-eater" baffle feed/resupply flow apertures sizes and shapes that may be tailored specifically for each pressure side and suction side axial flow channel to optimize both the radial and axial cooling flow distribution in each of the axial flow channels. Further, the axial channel flow area, Mach number, trip strip or heat transfer augmentation type (e.g., pitch, height, spacing, geometry, etc.) may be varied and included or omitted as desired for a specific airfoil application. Metering apertures and/or baffle retention features (support element retention features) located immediately upstream of the leading edge portion of the cavity may be customized for a specific application in terms of size, shape, blocking characteristics, etc. Such support element retention features may be spaced radially along the internal pressure side and/or suction side of the interior airfoil surfaces. It is noted that although shown and described above as having the support element retention features on the suction side with a mirror image implied upon the pressure side, in some embodiments, the support element retention features may be arranged on only one of the pressure or suction sides.

Orifices or apertures as described herein may be integral with axial ribs and/or may tailored radially in both flow area size and spacing depending on external heat load and cooling effectiveness requirements. Further, because the metering apertures are located adjacent to the leading edge pressure side and suction side internal surfaces, trip strips may be incorporated in the leading edge portion of the cavity to augment the local convective heat transfer and thermal cooling effectiveness at the leading edge of the airfoil. Moreover, the geometry of the support element retention features (e.g., height, width, length) may be tailored to optimize local conduction and fin efficiency. Further, advantageously, in some embodiments, the support element retention features may also incorporate a variable taper depending on structural load and core die manufacturing requirements to mitigate die lock and die pull constraints.

Although the various above embodiments are shown as separate illustrations, those of skill in the art will appreciate that the various features can be combined, mix, and matched to form an airfoil having a desired cooling scheme that is enabled by one or more features described herein. Thus, the above described embodiments are not intended to be distinct arrangements and structures of airfoils, but rather are provided as separate embodiments for clarity and ease of explanation. For example, different axial extending rib orientations, geometries, dimensions, etc. and features thereof may be selected for a desired cooling scheme of an airfoil, and each individual disclosed and described embodiment is not intended to be limiting, but rather provided for explanatory and illustrative purposes only.

As used herein, the terms "about" and "substantially" are intended to include the degree of error associated with measurement of the particular quantity based upon the equipment available at the time of filing the application. For example, "about" may include a range of ±8%, or 5%, or 2% of a given value or other percentage change as will be appreciated by those of skill in the art for the particular measurement and/or dimensions referred to herein. Further, for example, the term "substantially" allows for deviations with the skill of those in the art.

The terminology used herein is for the purpose of describing particular embodiments only and is not intended to be limiting of the present disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof. It should be appreciated that relative positional terms such as "forward," "aft," "upper," "lower," "above," "below," "radial," "axial," "circumferential," and the like are with reference to normal operational attitude and should not be considered otherwise limiting.

While the present disclosure has been described with reference to an illustrative embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A component for a gas turbine engine, the component comprising:

an airfoil having a leading edge, a trailing edge, a pressure side, and a suction side, wherein the airfoil defines at least a leading edge cavity located proximate the leading edge and defined between the leading edge and a separator rib in an axial direction and between the pressure side and the suction side in a circumferential direction, the leading edge cavity comprising a baffle portion and a leading edge portion, with the baffle portion aft of the leading edge portion in the axial direction;

a baffle installed within the baffle portion of the leading edge cavity, the baffle having a first metering flow aperture;

a first support element retention feature located within the leading edge cavity and at least partially separating the baffle portion from the leading edge portion, the first support element retention feature extending inward in the circumferential direction from one of the pressure side and the suction side and into the leading edge cavity;

a first axial extending rib extending between an aft end proximate the separator rib and a forward end proximate the first support element retention feature and formed on an interior surface of a same side as the first support element retention feature, wherein the first support element retention feature has a height extending from the respective side of the leading edge cavity that is greater than a respective height of the first axial extending rib, and wherein the baffle is retained aft of the first support element retention feature within the baffle portion, wherein a first axial extending flow channel is defined along the first axial extending rib between an exterior surface of the baffle and an interior surface of the airfoil and extending from the aft end to the forward end in an axial direction, and wherein the first metering flow aperture is located proximate the aft end of the first axial extending flow channel such that air flowing through the first metering flow aperture into the first axial extending flow channel will flow forward toward the leading edge portion of the leading edge cavity.

2. The component of claim 1, further comprising a plurality of additional axial extending ribs arranged on the same interior surface as the first axial extending rib, wherein a plurality of additional axial extending flow channels are defined between adjacent axial extending ribs.

3. The component of claim 1, further comprising:

a second support element retention feature located within the leading edge cavity and at least partially separating the baffle portion from the leading edge portion, the second support element retention feature on the other of the pressure side and the suction side of the leading edge cavity from the first support element retention feature;

a second axial extending rib extending between the aft end proximate the separator rib and the forward end proximate the second support element retention feature and formed on an interior surface of a same side as the second support element retention feature, wherein a second axial extending flow channel is defined along the second axial extending rib between an exterior surface of the baffle and an interior surface of the airfoil and extending from the aft end to the forward end in an axial direction.

4. The component of claim 1, wherein the baffle comprises at least one impingement aperture configured to fluidly connect to the leading edge portion of the leading edge cavity.

5. The component of claim 1, wherein the first axial extending rib has a variable radial height in a direction from the aft end to the forward end.

6. The component of claim 1, wherein the interior surface of the airfoil defining a portion of the first axial extending flow channel includes at least one heat transfer augmentation feature.

7. The component of claim 6, wherein the at least one heat transfer augmentation feature comprises at least one of trip strips, pin fins, and pedestals.

8. The component of claim 6, wherein the at least one heat transfer augmentation feature comprises a plurality of heat transfer augmentation features that extend along the interior surface of the airfoil from the separator rib into the leading edge portion of the leading edge cavity.

9. The component of claim 1, further comprising a second metering flow aperture defined at least partially by the first support element retention feature at the forward end of the first axial extending flow channel.

10. The component of claim 1, further comprising a second axial extending rib extending between the aft end and the forward end, wherein the first axial extending rib and the second axial extending rib are not parallel to each other.

11. A gas turbine engine comprising:

an airfoil having a leading edge, a trailing edge, a pressure side, and a suction side, wherein the airfoil defines at least a leading edge cavity located proximate the leading edge and defined between the leading edge and a separator rib in an axial direction and between the pressure side and the suction side in a circumferential direction, the leading edge cavity comprising a baffle portion and a leading edge portion, with the baffle portion aft of the leading edge portion in the axial direction;

a baffle installed within the baffle portion of the leading edge cavity, the baffle having a first metering flow aperture;

a first support element retention feature located within the leading edge cavity and at least partially separating the baffle portion from the leading edge portion, the first support element retention feature extending inward in the circumferential direction from one of the pressure side and the suction side and into the leading edge cavity;

a first axial extending rib extending between an aft end proximate the separator rib and a forward end proximate the first support element retention feature and formed on an interior surface of a same side as the first support element retention feature, wherein the first support element retention feature has a height extending from the respective side of the leading edge cavity that is greater than a respective height of the first axial extending rib, and wherein the baffle is retained aft of the first support element retention feature within the baffle portion, wherein a first axial extending flow channel is defined along the first axial extending rib between an exterior surface of the baffle and an interior surface of the airfoil and extending from the aft end to the forward end in an axial direction, and wherein the first metering flow aperture is located proximate the aft end of the first axial extending flow channel such that air flowing through the first metering flow aperture into the first axial extending flow channel will flow forward toward the leading edge portion of the leading edge cavity.

12. The gas turbine engine of claim 11, further comprising a plurality of additional axial extending ribs arranged on the same interior surface as the first axial extending rib, wherein a plurality of additional axial extending flow channels are defined between adjacent axial extending ribs.

13. The gas turbine engine of claim 11, further comprising:

a second support element retention feature located within the leading edge cavity and at least partially separating the baffle portion from the leading edge portion, the second support element retention feature on the other of the pressure side and the suction side of the leading edge cavity from the first support element retention feature;

a second axial extending rib extending between the aft end proximate the separator rib and the forward end proximate the second support element retention feature and formed on an interior surface of a same side as the second support element retention feature, wherein a second axial extending flow channel is defined along the second axial extending rib between an exterior surface of the baffle and an interior surface of the airfoil and extending from the aft end to the forward end in an axial direction.

14. The gas turbine engine of claim 11, wherein the baffle comprises at least one impingement aperture configured to fluidly connect to the leading edge portion of the leading edge cavity.

15. The gas turbine engine of claim 11, wherein the first axial extending rib has a variable radial height in a direction from the aft end to the forward end.

16. The gas turbine engine of claim 11, wherein the interior surface of the airfoil defining a portion of the first axial extending flow channel includes at least one heat transfer augmentation feature.

17. The gas turbine engine of claim 16, wherein the at least one heat transfer augmentation feature comprises at least one of trip strips, pin fins, and pedestals.

18. The gas turbine engine of claim 16, wherein the at least one heat transfer augmentation feature comprises a plurality of heat transfer augmentation features that extend along the interior surface of the airfoil from the separator rib into the leading edge portion of the leading edge cavity.

19. The gas turbine engine of claim 11, further comprising a second metering flow aperture defined at least partially by the first support element retention feature at the forward end of the first axial extending flow channel.

20. The gas turbine engine of claim 11, further comprising a second axial extending rib extending between the aft end and the forward end, wherein the first axial extending rib and the second axial extending rib are not parallel to each other.

* * * * *